US007658489B2

(12) United States Patent
Yamanobe

(10) Patent No.: US 7,658,489 B2
(45) Date of Patent: Feb. 9, 2010

(54) IMAGE FORMING APPARATUS AND IMAGE FORMING METHOD

(75) Inventor: Jun Yamanobe, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 427 days.

(21) Appl. No.: 11/203,238

(22) Filed: Aug. 15, 2005

(65) Prior Publication Data

US 2006/0033794 A1 Feb. 16, 2006

(30) Foreign Application Priority Data

Aug. 16, 2004 (JP) ..... 2004-236691

(51) Int. Cl.
*B41J 2/01* (2006.01)

(52) U.S. Cl. ..... 347/102

(58) Field of Classification Search ..... 347/73
See application file for complete search history.

(56) References Cited

U.S. PATENT DOCUMENTS 4,621,273 A * 11/1986 Anderson ..... 347/40
6,164,850 A * 12/2000 Speakman ..... 400/120.09
6,827,424 B2 * 12/2004 Teshigawara et al. ..... 347/43
6,834,948 B2 * 12/2004 Asano et al. ..... 347/102
2004/0085375 A1 * 5/2004 Hara ..... 347/15

FOREIGN PATENT DOCUMENTS

JP 2001-310454 A 11/2001
JP 2003-200564 A 7/2003
JP 2004-42548 A 2/2004

* cited by examiner

*Primary Examiner*—Julian D Huffman
*Assistant Examiner*—Alexander C Witkowski
(74) *Attorney, Agent, or Firm*—Birch, Stewart, Kolasch & Birch, LLP

(57) ABSTRACT

The image forming apparatus comprises: a print head including a plurality of nozzles which eject droplets of a radiation-curable ink onto a recording medium; a conveyance device which causes the print head and the recording medium to relatively move to each other in a relative conveyance direction of the recording medium by conveying at least one of the print head and the recording medium in a direction substantially perpendicular to a width direction of the recording medium; an irradiation device which irradiates a radiation to the droplets of the ink, the droplets having landed on the recording medium; and a control device which controls the irradiation device so that the radiation is irradiated to a first ink droplet while a second ink droplet is in flight, the first ink droplet having been previously ejected from one of the nozzles in the print head and having landed on the recording medium, the second ink droplet being ejected from the same one of the nozzles so as to overlap with or make contact with the first ink droplet on the recording medium.

12 Claims, 15 Drawing Sheets

IMAGE FORMING APPARATUS AND IMAGE FORMING METHOD

BACKGROUND OF THE INVENTION

1. Field of the Invention

The present invention relates to an image forming apparatus and an image forming method, and more particularly to an image forming apparatus and an image forming method for forming images by ejecting ink from nozzles.

2. Description of the Related Art

Inkjet type image forming apparatuses include an image forming apparatus which forms images by ejecting an ultraviolet-curable ink (so-called "UV ink") onto a recording medium from nozzles provided in a print head. Conventionally, an image forming apparatus of this kind irradiates ultraviolet light (UV light) to all or a portion of the image formed on a recording medium after the end of a printing operation by the print head, so as to harden and fix the ink droplets which have been ejected onto the recording medium.

However, if ejected ink droplets land on the recording medium at a time interval that is shorter than the time required to permeate into the recording medium or to become fixed thereon, the ink droplets form one large ink droplet by combining and overlapping with each other before becoming fixed on the recording medium, or the ink droplets in which the dot shape is deformed permeate into the recording medium, and then there is a possibility of giving rise to bleeding, color mixing, and the like, so-called landing interference or droplet interference. Consequently, technology for preventing landing interference of this kind has been proposed (see Japanese Patent Application Publication Nos. 2001-310454, 2004-42548, and 2003-200564, for example).

Japanese Patent Application Publication No. 2001-310454 discloses a technology that an ultraviolet light irradiating unit provided in the print head irradiates ultraviolet light at the timing at which the ink droplets land on the recording medium.

Japanese Patent Application Publication No. 2004-42548 discloses a technology that a pre-hardening (preliminary hardening) operation is performed by irradiating ultraviolet light of a level sufficient to prevent mixing of ink droplets (dots) which have landed on the recording medium, whereupon ultraviolet light is subsequently irradiated again to perform main hardening operation.

Japanese Patent Application Publication No. 2003-200564 discloses a technology that an ultraviolet light source is provided on the back side of the print surface of a recording medium, ultraviolet light is irradiated from this light source to the recording medium. When a print head having nozzles is situated over the recording medium, irradiation of ultraviolet light to the nozzles is prevented by means of a shield plate which shields the ultraviolet light.

However, in the technology disclosed in Japanese Patent Application Publication No. 2001-310454, if the ultraviolet light is irradiated to the ink droplets on the recording medium, then a portion of the ultraviolet light is reflected and reaches the nozzles, thus causing the ink in the vicinity of the nozzle aperture (the ink in the vicinity of the nozzles) to harden. In particular, when ultraviolet light is irradiated from directly below the nozzles (in the ink ejection direction), the ink in the vicinity of the nozzles is liable to harden, and hence ejection faults such as nozzle blockages occur.

According to the technology disclosed in Japanese Patent Application Publication No. 2004-42548, if different nozzles (or print heads) eject ink droplets at a prescribed time delay with respect to each other, landing interference between ink droplets (dots) ejected from different nozzles can be prevented by performing pre-hardening between each droplets ejection. However, this technology is not considered about landing interference of the ink droplets ejected from the same nozzle. For example, if ink is ejected from the same nozzle in consecutive ejection cycles, the pre-hardening is not performed between these ejections, and hence landing interference occurs. In addition, the reflected portion of the ultraviolet light irradiated to the ink droplets on the recording medium is liable to harden the ink in the vicinity of the nozzles.

In order to resolve the problem of ink solidification in the vicinity of the nozzles, in Japanese Patent Application Publication No. 2003-200564, as described previously, an ultraviolet light source is provided on the back side of the print surface of a recording medium, ultraviolet is irradiated from this light source to the recording medium, and irradiation of ultraviolet light to the nozzles is prevented by means of a shield plate which shields the ultraviolet light when a print head having nozzles is situated over the recording medium. However, if ink is ejected from the same nozzle in consecutive ejection cycles, then the ultraviolet light remains shielded by the shield plate. Therefore, the ink droplets on the recording medium may not be hardened, and then landing interference may occur.

SUMMARY OF THE INVENTION

The present invention is contrived in view of such circumstances, and an object thereof is to provide an image forming apparatus and an image forming method that can prevent landing interference between ink droplets ejected from the same nozzle, while also preventing hardening of ink in the vicinity of the nozzles.

In order to attain the aforementioned object, the present invention is disclosed to an image forming apparatus comprising: a print head including a plurality of nozzles which eject droplets of a radiation-curable ink onto a recording medium; a conveyance device which causes the print head and the recording medium to relatively move to each other in a relative conveyance direction of the recording medium by conveying at least one of the print head and the recording medium in a direction substantially perpendicular to a width direction of the recording medium; an irradiation device which irradiates a radiation to the droplets of the ink, the droplets having landed on the recording medium; and a control device which controls the irradiation device so that the radiation is irradiated to a first ink droplet while a second ink droplet is in flight, the first ink droplet having been previously ejected from one of the nozzles in the print head and having landed on the recording medium, the second ink droplet being ejected from the same one of the nozzles so as to overlap with or make contact with the first ink droplet on the recording medium.

According to the present invention, ultraviolet-curable ink having properties which can harden by radiation (electromagnetic waves including visible light, ultraviolet light or X-rays, an electron beam, or the like) is used as the printing ink. If the first and the second ink droplets are ejected from the same nozzle, then the control device causes the irradiation device to irradiate radiation to the first ink droplet on the recording medium, while the second ink droplet is in flight. The irradiation device does not irradiate ultraviolet light to the first ink droplet, before the second ink droplet has been ejected from the nozzle or after the second ink droplet has landed on the recording medium. Since the portion of the irradiated radiation reflected by the first ink droplet is absorbed or reflected by the second ink droplet in flight, it is possible to prevent hardening of the ink in the vicinity of the nozzle.

Furthermore, even if the second ink droplet lands on the recording medium so as to overlap with or make contact with the landed first ink droplet, the first ink droplet has been hardened by the irradiation of ultraviolet light to the first ink droplet, and hence it is possible to prevent landing interference.

The term "recording medium" indicates a medium on which an image is recorded by means of the action of the inkjet head (this medium may also be called a print medium, image forming medium, image receiving medium, or the like). This term includes various types of media, irrespective of material and size, such as continuous paper, cut paper, sealed paper, resin sheets, such as OHP sheets, film, cloth, a printed circuit board on which a wiring pattern, or the like, is formed by means of an inkjet head, and the like.

The conveyance device for causing the recording medium and the print head to move relative to each other may include a mode where the recording medium is conveyed with respect to a stationary (fixed) print head, or a mode where a print head is moved with respect to a stationary recording medium, or a mode where both the print head and the recording medium are moved.

The present invention is also directed to the image forming apparatus wherein the first ink droplet and the second ink droplet are ejected from the same one of the nozzles in consecutive ejection cycles.

When droplets are ejected to form dots which are consecutive at the output resolution dot pitch, the first and the second ink droplets which are ejected in consecutive ejection cycles from the same nozzle may be deposited so that the first and the second ink droplets overlap or make contact with each other on the recording medium, for the purpose of representing tones. Therefore, similarly to the aforementioned aspect, since the reflected light is absorbed or reflected by the second ink droplet in flight, it is possible to prevent hardening of the ink in the vicinity of the nozzles, as well as preventing landing interference between the first and second ink droplets by hardening the first ink droplet by irradiating the radiation to same.

The present invention is also directed to the image forming apparatus wherein the first ink droplet and the second ink droplet are aligned in the relative conveyance direction when landing on the recording medium.

According to the present invention, even if the first and the second ink droplets which have landed on the recording medium are aligned in the relative conveyance direction of the recording medium, the same beneficial effects as the aforementioned aspect are obtained. Therefore, it is possible to prevent hardening of the ink in the vicinity of the nozzles, while also preventing landing interference.

The present invention is also directed to the image forming apparatus wherein the irradiation device irradiates the radiation to at least a region of the first ink droplet on the recording medium, the region of the first ink droplet overlapping with the second ink droplet.

According to the present invention, since the irradiation energy required to be irradiated to the first ink droplet is small compared to a case in which the radiation is irradiated to all of the ink droplet, it is possible to prevent landing interference and hardening of the ink in the vicinity of the nozzles with good efficiency.

The present invention is also directed to the image forming apparatus wherein the irradiation device is disposed on an upstream side with respect to the print head in the relative conveyance direction.

According to the present invention, it is possible to readily irradiate the radiation to the region of the first ink droplet that the second ink droplet overlaps on the recording medium.

The present invention is also directed to the image forming apparatus wherein the control device controls the irradiation device so that the radiation is not irradiated to the first ink droplet on the recording medium when the second ink droplet is ejected so as not to overlap with or make contact with the first ink droplet on the recording medium.

The present invention is also directed to the image forming apparatus wherein the control device controls the irradiation device so that the radiation is not irradiated to the first ink droplet on the recording medium when the first ink droplet and the second ink droplet are not ejected in consecutive ejection cycles from same one of the nozzles.

According to the present invention, when the first and second ink droplets do not suffer landing interference, the irradiate device is controlled so that radiation is not irradiated. Therefore, since the radiation reaching the vicinity of the nozzles can be restricted, it is possible to prevent hardening of the ink in the vicinity of the nozzles.

The present invention is also directed to the image forming apparatus further comprising: a main curing device which irradiates the radiation for full-hardening the droplets of the ink, the main curing device being disposed on a downstream side of the print head in the relative conveyance direction, wherein the irradiation device irradiates the radiation at a level for semi-hardening an ink droplet which lands on the recording medium so that the ink droplet does not combine with the other droplets of the ink on the recording medium.

According to the present invention, since the irradiation energy emitted by the irradiation device is less than the irradiation energy by the main curing device, it is possible to prevent landing interference and hardening of the ink in the vicinity of the nozzles with good efficiency.

The present invention is also directed to the image forming apparatus wherein: an ultraviolet-curable ink is used as the radiation-curable ink; and the radiation irradiated by the main curing device or the irradiation device is an ultraviolet light.

According to the present invention, it is suitable to use an ultraviolet light LED element or ultraviolet light LD element in the irradiation device as a light source for hardening the ultraviolet-curable ink, and in the main hardening device, it is suitable to use a silver lamp, metal halide lamp, or the like. Therefore, even if ultraviolet-curable ink is used, it is possible to preventing landing interference and hardening of the ink in the vicinity of the nozzles.

The present invention is also directed to the image forming apparatus wherein: the nozzles are arranged in the print head two-dimensionally in a main scanning direction and a sub-scanning direction so that at least a few of dots overlap with each other in the main scanning direction, the main scanning direction being substantially perpendicular to a relative conveyance direction of the recording medium, the sub-scanning direction coinciding with the relative conveyance direction of the recording medium, the dots being formed on the recording medium by the droplets ejected from the nozzles; a distance in the sub-scanning direction between a first nozzle and a second nozzle is equal to an integral multiple of a distance in the sub-scanning direction between the first nozzle and a third nozzle, the first nozzle and the second nozzle ejecting the droplets to form mutually adjacent dots in the main scanning direction on the recording medium, the third nozzle being disposed adjacent to the first nozzle in the sub-scanning direction, the integral being at least two or more; and the first nozzle and the third nozzle are arranged in the main scanning direction so that a distance in the main scanning direction between the first nozzle and the third nozzle is no smaller than a maximum diameter of the dots formed on the recording medium by the droplets ejected from the first nozzle and the third nozzle.

According to the present invention, similarly to the beneficial effects of the aforementioned aspects, it is possible to prevent landing interference between ink droplets which are ejected onto adjacent positions in the sub-scanning direction. In addition, since the nozzle arrangement in the print head is composed as described above, it is possible to increase the time interval between the depositing times of ink droplets which are mutually adjacent in the main scanning direction of the recording medium. Therefore, it is possible to prevent landing interference between ink droplets which are ejected onto adjacent positions in the main scanning direction.

Furthermore, the present invention also provides a method for attaining the aforementioned objects. More specifically, the present invention is directed to an image forming method for an image forming apparatus comprising: a print head including a plurality of nozzles which eject an ultraviolet-curable ink onto a recording medium; and a conveyance device which causes the print head and the recording medium to relatively move to each other in a relative conveyance direction of the recording medium by conveying at least one of the print head and the recording medium in a direction substantially perpendicular to a width direction of the recording medium, the method comprising the steps of: irradiating a radiation to droplets of the ink, the droplets having landed on the recording medium; and controlling an irradiation in the irradiating step so that the radiation is irradiated to a first ink droplet while a second ink droplet is in flight, the first ink droplet having been previously ejected from one of the nozzles in the print head and having landed on the recording medium, the second ink droplet being ejected from the same one of the nozzles so as to overlap with or make contact with the first ink droplet on the recording medium.

As described above, according to the present invention, the ultraviolet-curable ink is used as the printing ink. When the first and the second ink droplets are ejected from the same nozzle, the irradiation device irradiates the radiation to the first ink droplet ejected previously onto the recording medium while the second ink droplet ejected subsequently is flight. The portion of the irradiated radiation reflected by the first ink droplet is absorbed or reflected by the second ink droplet in flight. Therefore, it is possible to prevent hardening of the ink in the vicinity of the nozzle.

Furthermore, even if the second ink droplet lands on the recording medium so as to overlap with or make contact with the first ink droplet, the first ink droplet has been hardened by the irradiation of ultraviolet light. Therefore, it is possible to prevent landing interference.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

General Composition of Inkjet Recording Apparatus

Figure 1:
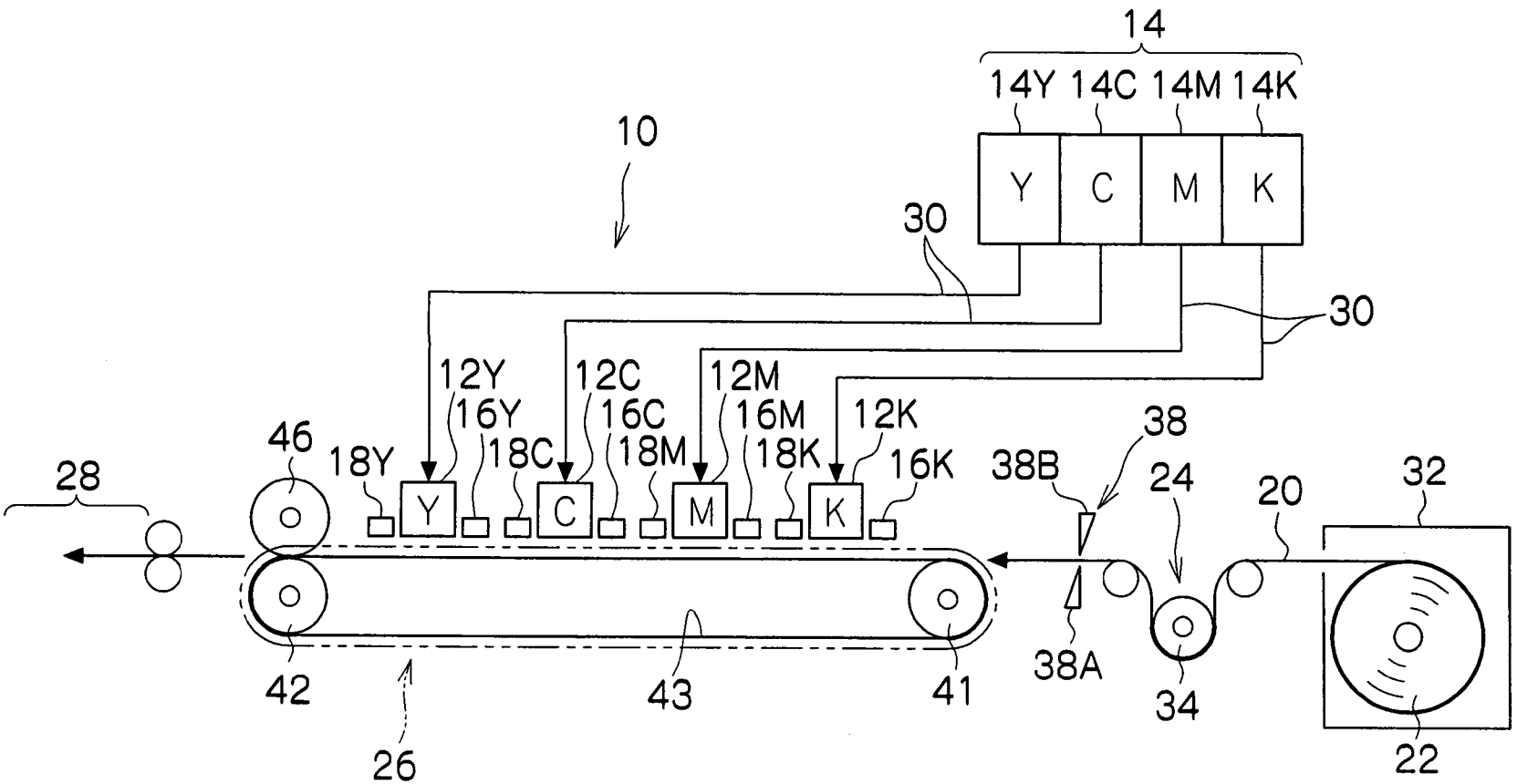
FIG. 1 is a general schematic diagram of an inkjet recording apparatus according to an embodiment of the present invention.

FIG. 1 is a general schematic diagram of an inkjet recording apparatus 10 according to an embodiment of the present invention. As shown in FIG. 1, the inkjet recording apparatus 10 comprises: a plurality of print heads 12K, 12M, 12C, and 12Y for ultraviolet-curable ink (so-called "U.V. ink") colors of black (K), magenta (M), cyan (C), and yellow (Y), respectively; an ink storing and loading unit 14 for storing inks of K, C, M and Y to be supplied to the print heads 12K, 12M, 12C and 12Y; preliminary curing light sources 16K 16M, 16C and 16Y respectively in front of each of the print heads 12K, 12M, 12C and 12Y; main curing light sources 18K, 18M, 18C and 18Y which are disposed respectively after each of the print heads 12K, 12M, 12C and 12Y; a paper supply unit 22 for supplying recording paper 20 forming a recording medium; a decurling unit 24 for removing curl in the recording paper 20; a suction belt conveyance unit 26 which is disposed facing the nozzle faces (ink ejection faces) of the print heads 12K, 12M, 12C, and 12Y, for conveying the recording paper 20 while keeping the recording paper 20 flat; and a paper output unit 28 for outputting recorded recording paper (printed matter) to the exterior.

The ultraviolet curable ink is an ink containing a component which hardens (polymerizes) upon application of ultraviolet energy (namely, an ultraviolet-curable component, such as a monomer, an oligomer, or a low-molecular-weight homopolymer, a copolymer, or the like), and a polymerization initiator. Therefore, the ink has a property whereby the ink starts to polymerize and as the polymerization progress when ultraviolet light is shined onto the ink, so that the viscosity of the ink increases and finally the ink hardens.

The ink storing and loading unit 14 has ink tanks 14K, 14M, 14C, and 14Y for storing the inks of the colors corresponding to the print heads 12K, 12M, 12C, and 12Y, and the tanks are connected to the print heads 12K, 12M, 12C, and 12Y through prescribed channels 30. The ink storing and loading unit 14 also comprises a warning device (for example, a display device or an alarm sound generator) for warning when the remaining amount of any ink is low, and has a mechanism for preventing loading errors among the colors.

In FIG. 1, a magazine 32 for rolled paper (continuous paper) is shown as an example of the paper supply unit 22; however, more magazines with paper differences such as paper width and quality may be jointly provided. Moreover, papers may be supplied with cassettes that contain cut papers loaded in layers and that are used jointly or in lieu of the magazine for rolled paper.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of paper to be used is automatically determined, and ink-droplet ejection is controlled so that the ink-droplets are ejected in an appropriate manner in accordance with the type of paper.

The recording paper 20 delivered from the paper supply unit 22 retains curl due to having been loaded in the magazine 32. In order to remove the curl, heat is applied to the recording paper 20 in the decurling unit 24 by a heating drum 34 in the direction opposite from the curl direction in the magazine 32. The heating temperature at this time is preferably controlled so that the recording paper 20 has a curl in which the surface on which the print is to be made is slightly round outward.

In the case of the configuration in which roll paper is used, a cutter 38 is provided as shown in FIG. 1, and the continuous paper is cut into a desired size by the cutter 38. The cutter 38 has a stationary blade 38A, of which length is not less than the width of the conveyor pathway of the recording paper 20, and a round blade 38B, which moves along the stationary blade 38A. The stationary blade 38A is disposed on the reverse side of the printed surface of the recording paper 20, and the round blade 38B is disposed on the printed surface side across the conveyor pathway. When cut papers are used, the cutter 38 is not required.

After decurling in the decurling unit 24, the cut recording paper 20 is delivered to the suction belt conveyance unit 26. The suction belt conveyance unit 26 has a configuration in which an endless belt 43 is set around rollers 41 and 42 in such a manner that at least the portion of the endless belt 43 facing the nozzle faces of the print heads 12K, 12M, 12C and 12Y forms a horizontal plane (flat plane).

The belt 43 has a width that is greater than the width of the recording paper 20, and a plurality of suction apertures (not shown) are formed on the belt surface. A suction chamber (not illustrated) is provided on the inner side of the belt 43 set about the rollers 41 and 42, and the recording paper 20 is suctioned and held on the belt 43 by creating a negative pressure by suctioning the suction chamber with a fan.

The belt 43 is driven in the clockwise direction in FIG. 1 by the motive force of a motor (not shown in FIG. 1, but shown as a motor 134 in FIG. 14) being transmitted to at least one of the rollers 41 and 42, which the belt 43 is set around, and the recording paper 20 held on the belt 43 is conveyed from left to right in FIG. 1.

Each of the print heads 12K, 12M, 12C and 12Y is full line head having a length corresponding to the maximum width of the recording paper 20 used with the inkjet recording apparatus 10, and comprising a plurality of nozzles for ejecting ink which are arranged on a nozzle face through a length exceeding at least one edge of the maximum-size recording paper 20 (namely, the full width of the printable range).

The print heads 12K, 12M, 12C and 12Y are arranged in color order from the upstream side in the feed direction of the recording paper 20, and the print heads 12K, 12M, 12C and 12Y are fixed extending in a direction substantially perpendicular to the conveyance direction of the recording paper 20.

A color image can be formed on the recording paper 20 by ejecting inks of different colors from the print heads 12K, 12M, 12C and 12Y, respectively, onto the recording paper 20 while the recording paper 20 is conveyed by the suction belt conveyance unit 26.

The print heads 12K, 12M, 12C and 12Y, in which the full-line heads covering the entire width (the entire width of the printable region) of the paper are thus provided for the respective ink colors, can record an image over the entire surface of the recording paper 20 by performing the action of moving the recording paper 20 and the print heads 12K, 12M, 12C and 12Y relatively to each other in the sub-scanning direction just once (in other words, by means of a single sub-scan). A single pass image forming apparatus of this kind is able to print at high speed in comparison with a shuttle scanning system in which an image is printed by moving a print head back and forth reciprocally in a direction perpendicular to the sub-scanning direction (main scanning direction), and hence print productivity can be improved.

Although the configuration with the KMCY four standard colors is described in the present embodiment, combinations of the ink colors and the number of colors are not limited to those. Light inks or dark inks can be added as required. For example, a configuration is possible in which print heads for ejecting light-colored inks such as light cyan and light magenta are added. Furthermore, there are no particular restrictions of the sequence in which the print heads of respective colors are arranged.

The preliminary curing light sources 16K, 16M, 16C and 16Y irradiate the ink droplets ejected from the nozzles (not shown in FIG. 1, but shown as reference numeral 51 in FIGS. 2A and 2B) of the print heads 12K, 12M, 12C and 12Y situated adjacently on the downstream side, which have landed on the recording paper 20, with the ultraviolet light having an energy sufficient to change the ink droplets to a semi-hardened state (a semi-solidified state in which the ink droplets have not hardened completely). This irradiation of ultraviolet light is performed respectively for the nozzles provided in each of the print heads 12K, 12M, 12C and 12Y. When the ink droplets are ejected in consecutive ejection cycles from the same nozzle, the ultraviolet light is irradiated onto the ink droplets on the recording paper 20 which have been ejected by that nozzle.

In the preliminary curing light sources 16K, 16M, 16C and 16Y, it is suitable to use ultraviolet LED elements (not shown in FIG. 1, but shown as reference numeral 80 in FIG. 7) or ultraviolet LD elements (not shown), or the like. The composition and the control according to the preliminary curing light sources 16K, 16M, 16C and 16Y are described below.

The main curing light sources 18K, 18M, 18C and 18Y are provided on the downstream side of the respective print heads 12K, 12M, 12C and 12Y, and irradiate the ultraviolet light sufficient to harden completely the ink droplets which have landed on the recording paper 20 so as to fix the ink droplets completely.

In the main curing light sources 18K, 18M, 18C and 18Y, it is suitable to use a mercury lamp, a metal halide lamp, or the like. Each of the main curing light sources 18K, 18M, 18C and 18Y has a broader waveband than the ultraviolet LED elements 80, and outputs a greater quantity of light. Furthermore, between the main curing light sources 18K, 18M, 18C and 18Y and the adjacent print heads 12K, 12M, 12C and 12Y, light shielding members (not shown) are provided in order to prevent the ultraviolet light from the main curing light sources 18K, 18M, 18C and 18Y from reaching the print heads 12K, 12M, 12C and 12Y.

The main curing light sources 18K, 18M and 18C disposed between the print heads 12K, 12M, 12C and 12Y irradiate the ultraviolet light onto the recording paper 20 after the recording paper 20 has passed the upstream side print heads 12K, 12M, and 12C and before the recording paper 20 passes below the downstream side print heads 12M, 12C and 12Y, and then the ink droplets on the recording paper 20 are changed to a completely hardened state so that droplet ejection can be performed by the subsequent print head of a different color.

More specifically, in FIG. 1, when the black color ink droplets are ejected consecutively by the same nozzle in the black color print head 12K, the preliminary curing light source 16K irradiates the ultraviolet light onto the first ink droplet ejected onto the recording paper 20 so as to semi-harden the first ink droplet. Next, the recording paper 20 is irradiated with the ultraviolet light by the main curing light source 18K, and then the magenta color ink droplets are ejected by the magenta color print head 12M. Similarly, when magenta color ink droplets are ejected consecutively by the same nozzle of the magenta color print head 12M, the ultraviolet light is irradiated by the preliminary curing light source 16M, and then the ultraviolet light is irradiated by the main curing light source 18M. Thereafter, the droplet ejection and the irradiation of ultraviolet light are repeated in a similar manner in the cyan and yellow color print heads 12C and 12Y.

After passing through the yellow print head 12Y, the ink droplets on the recording paper 20 irradiated with the ultraviolet light by the main curing light source 18Y, so as to achieve a hardening level sufficient to prevent image deterioration during subsequent handling, such as rubbing of the image surface by rollers, or the like, in downstream stages. In this way, the ink on the recording paper 20 is hardened completely.

Incidentally, the main curing light sources 18K, 18M, 18C and 18Y are provided respectively on the downstream side of the respective print heads 12K, 12M, 12C and 12Y in FIG. 1, but even if only the main curing light source 18Y situated in the furthest downstream position is provided, it is also possible to prevent landing interference between the different colors, due to the presence of the preliminary curing light sources 16K, 16M, 16C and 16Y.

A pressurizing and fixing roller 46 is provided on the downstream side of the main curing light source 18Y. The pressurizing and fixing roller 46 is a device for controlling the glossiness and evenness on the image surface of the recording paper 20.

The printed object generated in this manner is outputted via the paper output unit 28. Although not shown in FIG. 1, the paper output unit 28 is provided with a sorter for collecting images according to print orders.

Incidentally, the hardened state of the ink droplets irradiated with the ultraviolet light by the main curing light sources 18K, 18M, and 18C, is not limited to a full-hardened state. It may also be a semi-hardened state of a hardening level which prevents the ink from mixing with ink droplets ejected from the nozzles of downstream side print heads 12M, 12C, and 12Y. In this case, the main curing light source 18Y at the furthest downstream position should irradiates the sufficient ultraviolet light to cause complete fixing of the ink. Furthermore, it is also possible to omit the main curing light sources 18K, 18M and 18C, so as to irradiate ultraviolet sufficient to achieve complete hardening of the ink by means of the main curing light source 18Y at the furthest downstream position.

Structure of Print Head

Next, the structure of a print head will be described. The print heads 12K, 12M, 12C and 12Y provided for the respective ink colors have the same structure, and a reference numeral 50 is hereinafter designated to any of the print heads 12K, 12M, 12C and 12Y.

Figure 2A:
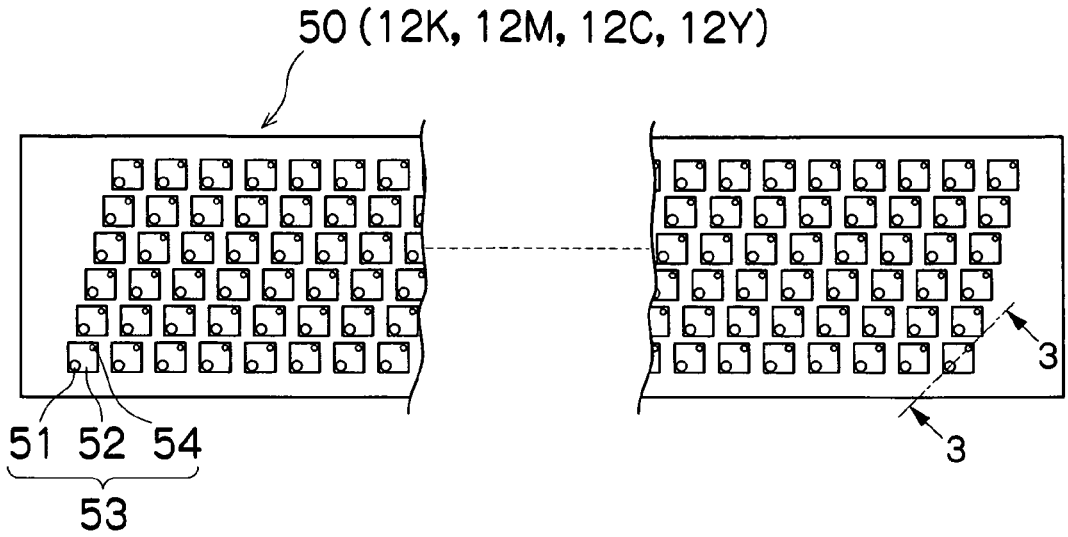
FIG. 2A is plan view perspective diagram showing an example of the structure of a print head.
Figure 2B:
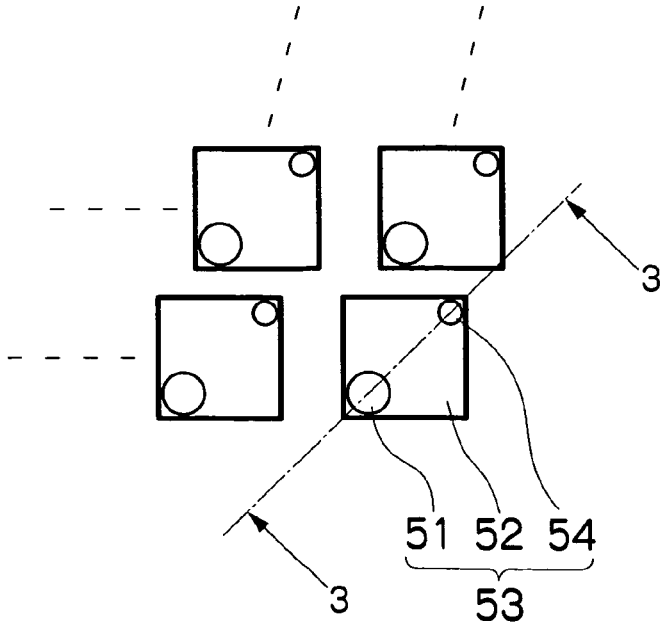
FIG. 2B is an enlarged view of a portion thereof.
Figure 3:
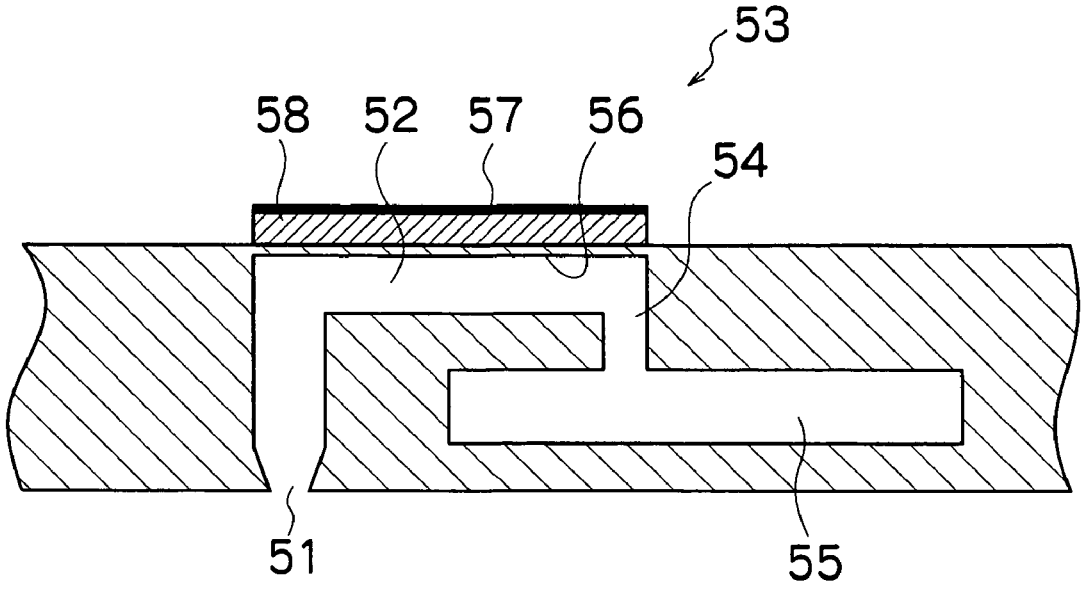
FIG. 3 is a cross-sectional view along line 3-3 in FIGS. 2A and 2B.

FIG. 2A is a perspective plan view showing an example of the configuration of the print head 50, FIG. 2B is an enlarged view of a portion thereof, FIG. 3 is a cross-sectional view taken along the line 3-3 in FIGS. 2A and 2B, showing the inner structure of a droplet ejection element (an ink chamber unit for one nozzle 51).

The nozzle pitch in the print head 50 should be minimized in order to maximize the density of the dots printed on the surface of the recording paper. As shown in FIGS. 2A, 2B and 3, the print head 50 according to the present embodiment has a structure in which a plurality of ink chamber units (droplet ejection elements) 53, each comprising a nozzle 51 forming an ink droplet ejection port, a pressure chamber 52 corresponding to the nozzle 51, and the like, are disposed two-dimensionally in the form of a staggered matrix, and hence the effective distance between the nozzles (the projected nozzle pitch) as projected in the lengthwise direction of the print head (the direction perpendicular to the paper conveyance direction) is reduced and high nozzle density is achieved.

As shown in FIGS. 2A and 2B, the planar shape of the pressure chamber 52 provided for each nozzle 51 is substantially a square, and an outlet to the nozzle 51 and an inlet of supplied ink (supply port) 54 are disposed in both corners on a diagonal line of the square.

As shown in FIG. 3, each pressure chamber 52 is connected to a common channel 55 through the supply port 54. The common channel 55 is connected to an ink tank 60 (not shown in FIG. 3, but shown in FIG. 5), which is a base tank that supplies ink, and the ink supplied from the ink tank 60 is delivered through the common channel 55 in FIG. 3 to the pressure chambers 52.

An actuator 58 provided with an individual electrode 57 is joined to a pressure plate (common electrode) 56 which forms the upper face of the pressure chamber 52, and the actuator 58 is deformed when a drive voltage is supplied to the individual electrode 57, thereby causing ink to be ejected from the nozzle 51. A piezoelectric body, such as a piezo element, is suitable as the actuator 58. When ink is ejected, new ink is supplied to the pressure chamber 52 from the common channel 55 through the supply port 54.

Figure 4:
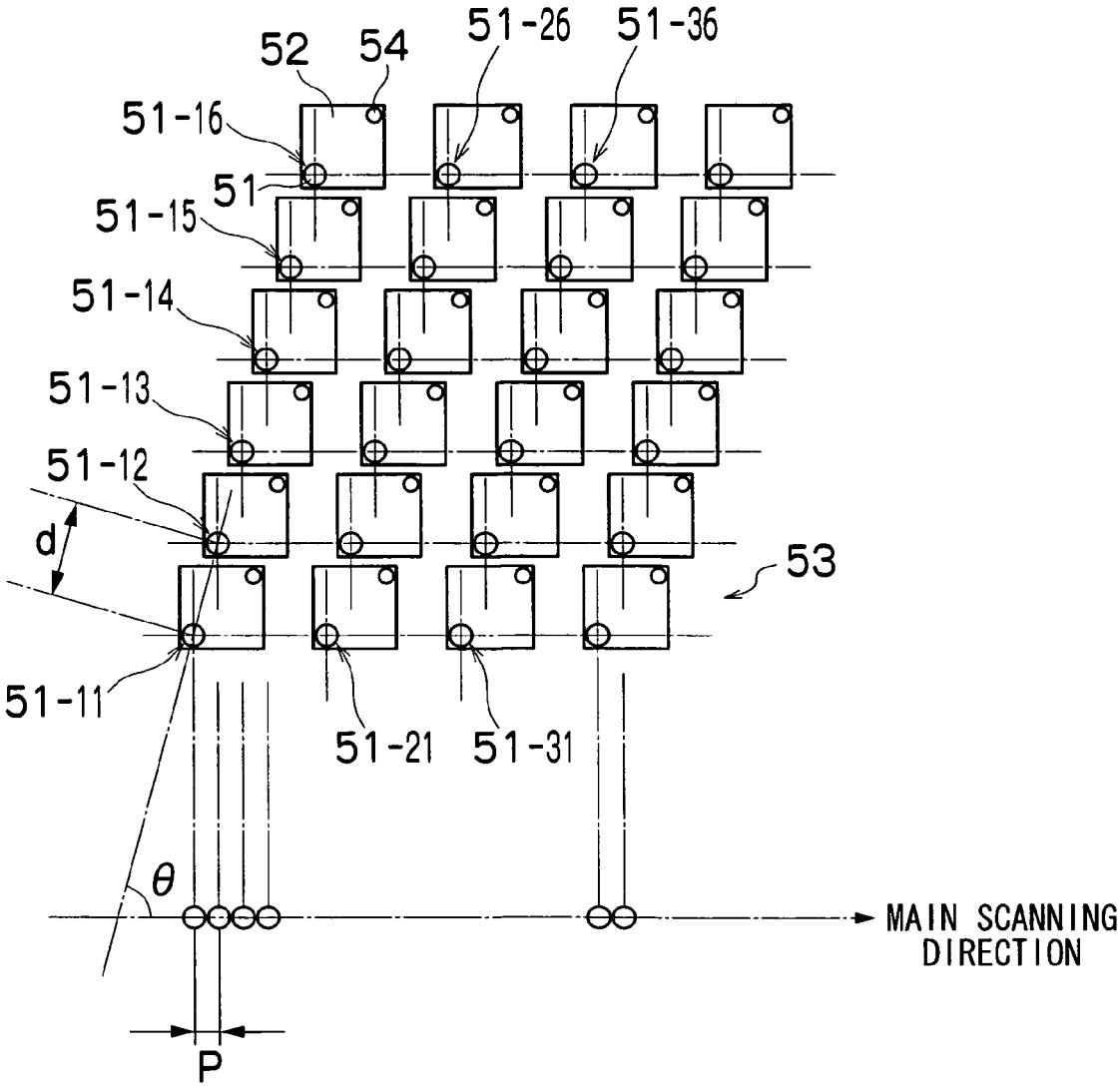
FIG. 4 is an enlarged view showing an example of a nozzle arrangement in the print head illustrated in FIGS. 2A and 2B.

As shown in FIG. 4, the plurality of ink chamber units 53 having this structure are composed in a lattice arrangement, based on a fixed arrangement pattern having a row direction which coincides with the main scanning direction, and a column direction which, rather than being perpendicular to the main scanning direction, is inclined at a fixed angle of θ with respect to the main scanning direction. By adopting a structure wherein a plurality of ink chamber units 53 are arranged at an uniform pitch d in a direction having an angle θ with respect to the main scanning direction, the pitch P of the nozzles when projected to an alignment in the main scanning direction will be d×cos θ.

More specifically, the arrangement can be treated equivalently to one wherein the respective nozzles 51 are arranged in a linear fashion at uniform pitch P, in the main scanning direction. By means of this composition, it is possible to achieve a nozzle composition of high density, wherein the nozzle columns projected to an alignment in the main scanning direction reach a total of 2400 per inch (2400 nozzles per inch).

In a full-line head comprising rows of nozzles that have a length corresponding to the entire width of the image recordable width, "main scanning" is defined as to print one line (a line formed of a row of dots, or a line formed of a plurality of rows of dots) in the width direction of the recording paper (the direction perpendicular to the conveyance direction of the recording paper) by driving the nozzles in one of the following ways: (1) simultaneously driving all the nozzles; (2) sequentially driving the nozzles from one side toward the other; and (3) dividing the nozzles into blocks and sequentially driving the blocks of the nozzles from one side toward the other.

Figure 5:
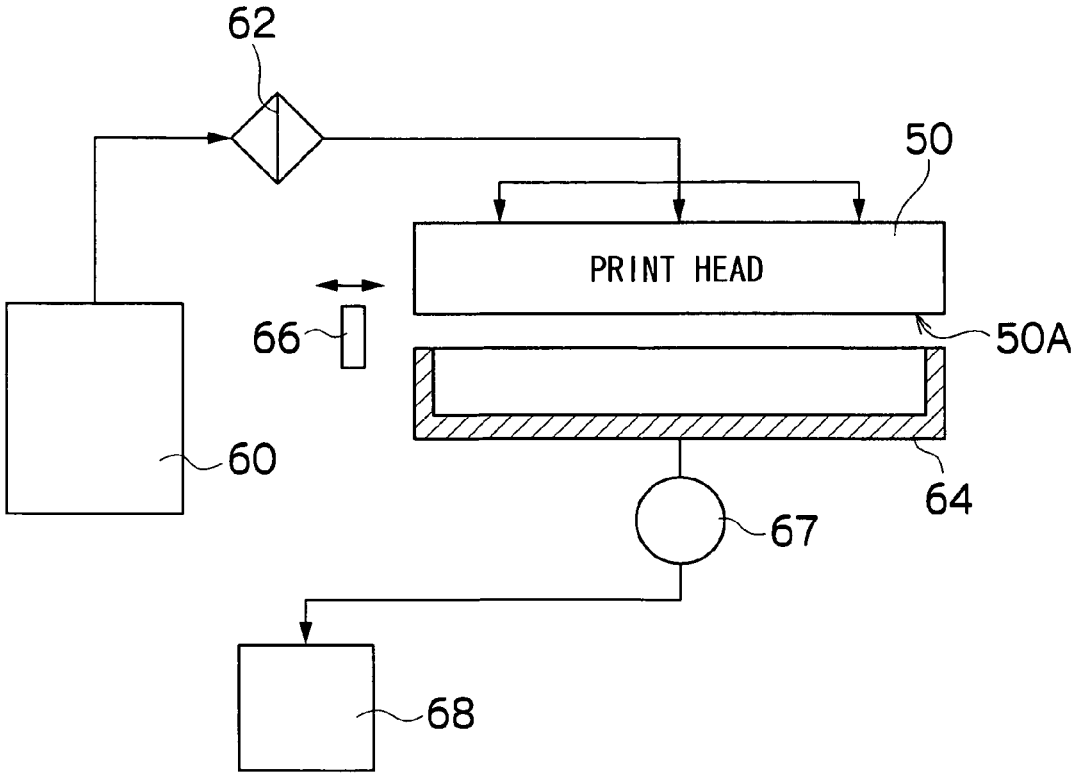
FIG. 5 is a schematic diagram showing the composition of an ink supply system according to the embodiment.

In particular, when the nozzles 51 arranged in a matrix such as that shown in FIG. 5 are driven, the main scanning according to the above-described (3) is preferred. More specifically, the nozzles 51-11, 51-12, 51-13, 51-14, 51-15 and 51-16 are treated as a block (additionally; the nozzles 51-21, 51-22, . . . , 51-26 are treated as another block; the nozzles 51-31, 51-32, . . . , 51-36 are treated as another block; . . . ); and one line is printed in the width direction of the recording paper 20 by sequentially driving the nozzles 51-11, 51-12, . . . , 51-16 in accordance with the conveyance velocity of the recording paper 20.

On the other hand, "sub-scanning" is defined as to repeatedly perform printing of one line (a line formed of a row of dots, or a line formed of a plurality of rows of dots) formed by the main scanning, while moving the full-line head and the recording paper relatively to each other.

In implementing the present invention, the arrangement of the nozzles is not limited to that of the example illustrated. Moreover, a method is employed in the present embodiment where an ink droplet is ejected by means of the deformation of the actuator 58, which is typically a piezoelectric element; however, in implementing the present invention, the method used for discharging ink is not limited in particular, and instead of the piezo method, it is also possible to apply various types of methods, such as a thermal jet method where the ink is heated and bubbles are caused to form therein by means of a heat generating body such as a heater, ink droplets being ejected by means of the pressure applied by these bubbles.

Configuration of Ink Supply System

FIG. 5 is a schematic drawing showing the configuration of the ink supply system in the inkjet recording apparatus 10. The ink tank 60 is a base tank that supplies ink to the print head 50 and is set in the ink storing and loading unit 14 described with reference to FIG. 1. The aspects of the ink tank 60 include a refillable type and a cartridge type: when the remaining amount of ink is low, the ink tank 60 of the refillable type is filled with ink through a filling port (not shown) and the ink tank 60 of the cartridge type is replaced with a new one. In order to change the ink type in accordance with the intended application, the cartridge type is suitable, and it is preferable to represent the ink type information with a bar code or the like on the cartridge, and to perform ejection control in accordance with the ink type. The ink tank 60 in FIG. 5 is equivalent to the ink storing and loading unit 14 in FIG. 1 described above.

A filter 62 for removing foreign matters and bubbles is disposed between the ink tank 60 and the print head 50 as shown in FIG. 5. The filter mesh size in the filter 62 is preferably equivalent to or less than the diameter of the nozzle and commonly about 20 μm. Although not shown in FIG. 5, it is preferable to provide a sub-tank integrally to the print head 50 or nearby the print head 50. The sub-tank has a damper function for preventing variation in the internal pressure of the head and a function for improving refilling of the print head.

The inkjet recording apparatus 10 is also provided with a cap 64 as a device to prevent the nozzles 51 from drying out or to prevent an increase in the ink viscosity in the vicinity of the nozzles 51, and a cleaning blade 66 as a device to clean the nozzle face 50A. A maintenance unit including the cap 64 and the cleaning blade 66 can be relatively moved with respect to the print head 50 by a movement mechanism (not shown), and is moved from a predetermined holding position to a maintenance position below the print head 50 as required.

The cap 64 is displaced up and down relatively with respect to the print head 50 by an elevator mechanism (not shown). When the power of the inkjet recording apparatus 10 is turned OFF or when in a print standby state, the cap 64 is raised to a predetermined elevated position so as to come into close contact with the print head 50, and the nozzle face 50A is thereby covered with the cap 64.

The cleaning blade 66 is composed of rubber or another elastic member, and can slide on the ink ejection surface (surface of the nozzle plate) of the print head 50 by means of a blade movement mechanism (not shown). When ink droplets or foreign matter has adhered to the nozzle plate, the surface of the nozzle is wiped and cleaned by sliding the cleaning blade 66 on the nozzle plate.

During printing or standby, when the frequency of use of specific nozzles 51 is reduced and ink viscosity increases in the vicinity of the nozzles, a preliminary discharge is made to eject the degraded ink toward the cap 64.

Also, when bubbles have become intermixed in the ink inside the print head 50 (inside the pressure chamber 52), the cap 64 is placed on the print head 50, the ink inside the pressure chamber 52 (the ink in which bubbles have become intermixed) is removed by suction with a suction pump 67, and the suction-removed ink is sent to a collection tank 68. This suction action entails the suctioning of degraded ink of which viscosity has increased (hardened) also when initially loaded into the print head 50, or when service has started after a long period of being stopped.

When a state in which ink is not ejected from the print head 50 continues for a certain amount of time or longer, the ink solvent in the vicinity of the nozzles 51 evaporates and ink viscosity increases. In such a state, ink can no longer be ejected from the nozzle 51 even if the actuator 58 for the ejection driving is operated. Before reaching such a state (in a viscosity range that allows ejection by the operation of the actuator 58) the actuator 58 is operated to perform the preliminary discharge to eject the ink of which viscosity has increased in the vicinity of the nozzle toward the ink receptor. After the nozzle surface is cleaned by a wiper such as the cleaning blade 66 provided as the cleaning device for the nozzle face 50A, a preliminary discharge is also carried out in order to prevent the foreign matter from becoming mixed inside the nozzles 51 by the wiper sliding operation. The preliminary discharge is also referred to as "dummy discharge", "purge", "liquid discharge", and so on.

When bubbles have become intermixed in the nozzle 51 or the pressure chamber 52, or when the ink viscosity inside the nozzle 51 has increased over a certain level, ink can no longer be ejected by means of a preliminary ejection, and hence a suctioning action is carried out as follows.

More specifically, when bubbles have become intermixed in the ink inside the nozzle 51 and the pressure chamber 52 or when the ink viscosity inside the nozzle 51 has increased over a certain level, ink can no longer be ejected from the nozzle 51 even if the actuator 58 is operated. In a case of this kind, a cap 64 is placed on the nozzle surface of the print head 50, and the ink containing air bubbles or the ink of increased viscosity inside the pressure chambers 52 is suctioned by a pump 67.

However, since this suction action is performed with respect to all the ink in the pressure chambers 52, the amount of ink consumption is considerable. Therefore, a preferred aspect is one in which a preliminary discharge is performed when the increase in the viscosity of the ink is small.

The cap 64 described in FIG. 5 functions as a suctioning device, and it may also function as an ink receptacle for preliminary ejection.

Compositional Example of Preliminary Curing Light Source

Next, the structure of a preliminary curing light source will be described. The preliminary curing light sources 16K, 16M, 16C and 16Y provided respectively on the upstream sides of the print heads 12K, 12M, 12C, and 12Y have a common structure, and therefore, the reference numeral 16 is used below to indicate a representative example of a preliminary curing light source. Furthermore, the main curing light sources 18K, 18M, 18C and 18Y provided respectively on the downstream sides of the print heads 12K, 12M, 12C, and 12Y also have a common structure, and therefore the reference numeral 18 is used to indicate a main curing light source.

Figure 6:
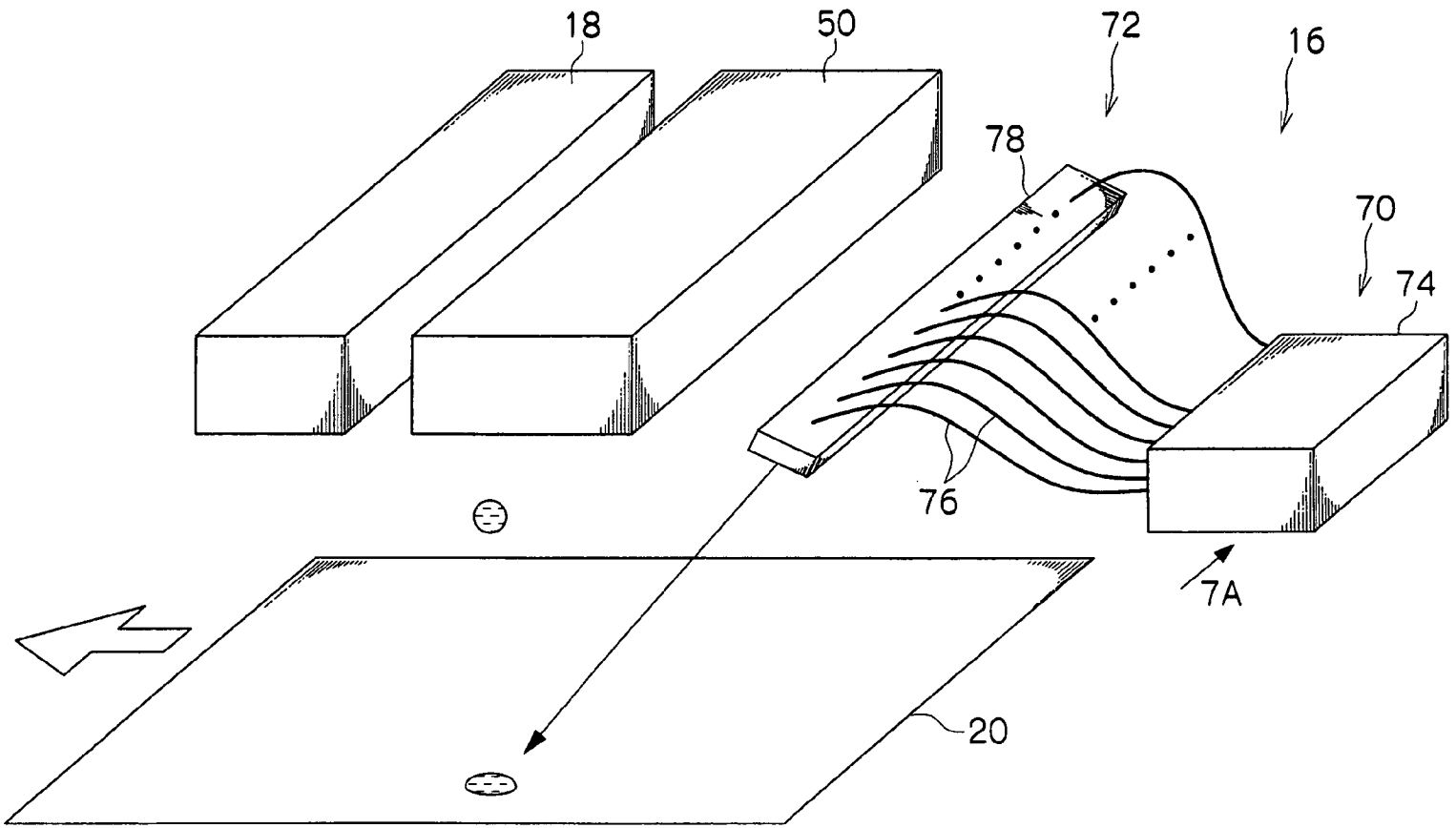
FIG. 6 is a compositional diagram showing an example of the structure of a preliminary curing light source according to the embodiment.
Figure 7:
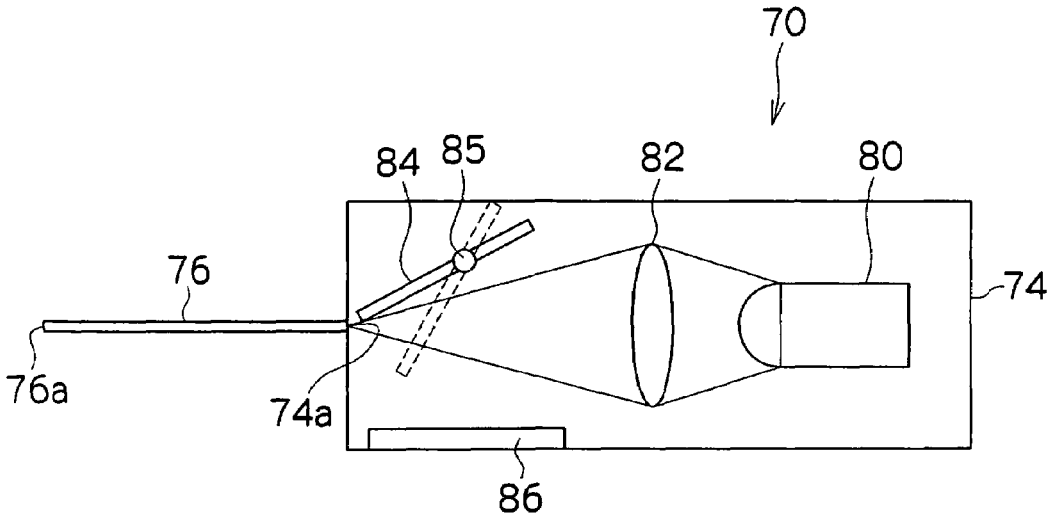
FIG. 7 is a cross-sectional view showing an example of the internal composition of an irradiation unit of a preliminary curing light source, showing a cross-section in the direction of arrow 7A in FIG. 6.

FIG. 6 is a compositional diagram showing an example of the structure of a preliminary curing light source 16. FIG. 7 is a cross-sectional view showing an example of the internal composition of the irradiating unit 70 of the preliminary curing light source 16 illustrated in FIG. 6 (a cross-sectional view in the direction of arrow 7A in FIG. 6). In FIGS. 6 and 7, identical reference numerals denote parts that are common to FIG. 1. As shown in FIG. 6, the preliminary curing light source 16 is disposed on the upstream side of the print head 50 in respect of the paper conveyance direction (the direction indicated by the arrow in FIG. 6), and is constituted by an irradiation unit 70 having an ultraviolet light LED element (see FIG. 7) disposed inside an internal shield surround 74, a fiber-optic cable 76 connected to the irradiation unit 70, and a fixing member 78 for fixing the irradiation direction of the fiber-optic cable 76.

The number of fiber-optic cables 76 are the same as the number of nozzles constituting in the print head 50, and the fiber-optic cables 76 are arranged respectively in the direction that the light is irradiated to the ink droplets ejected onto the recording paper 20 by the nozzles 51 (see FIGS. 2A and 2B) of the print head 50.

As shown in FIG. 7, the irradiation unit 70 is basically constituted inside a shield surround 74 by an ultraviolet LED element 80, and a condensing lens 82 such as a cylindrical lens which condenses the light emitted by the ultraviolet LED element 80 (ultraviolet light) into a linear light beam. In implementing the present invention, the condensing lens 82 is not limited to one which condenses the light into a linear light beam, and it is also possible to provide lenses which condense the light into a light spot, and ultraviolet LED elements 80, respectively in numbers corresponding to the number of fiber-optic cables 76.

The shield surround 74 is formed with fine openings 74*a* forming light outlets, in equal number of the fiber-optic cables 76. One end of a fiber-optic cable 76 is connected to each of the openings 74*a*. The other ends of the fiber-optic cables 76 are formed into irradiation ports 76*a* which irradiate the light, and the irradiation ports 76*a* are fixed by a fixing member 78, as shown in FIG. 6, thereby securing to the direction of irradiation thereof.

The light emitted by the ultraviolet LED element 80 is condensed to the respective openings 74*a* by the condensing lens 82, so that light is irradiated from the irradiation ports 76*a* of the respective fiber-optic cables 76.

Furthermore, in the shield surround 74, a mirror member 84 is provided at each of the openings 74*a*, which is supported axially on a supporting shaft 85 so as to be rotatably through the supporting shaft 85. By controlling the respective positions of the mirror members 84, it is possible to select whether or not to irradiate the ultraviolet light from the respective irradiation ports 76*a* of the fiber-optic cables 76 formed corresponding to the mirror members 84, to the respective ink droplets landed on the recording paper 20 from the nozzles 51.

More specifically, when a mirror member 84 is situated in the irradiation position shown by the solid line in FIG. 7, the ultraviolet light condensed by the condensing lens 82 reaches the opening 74*a*. On the other hand, when the mirror member 84 is situated in the non-irradiation position shown by the broken line in FIG. 7, the ultraviolet light condensed by the condensing lens 82 is reflected by the mirror member 84, and hence the ultraviolet light does not reach to the opening 74*a*. An ultraviolet light absorbing member 86 is disposed so as to absorb the reflected ultraviolet light when the mirror member 84 is situated in the non-irradiation position.

By this composition, when the mirror member 84 is situated in the irradiation position, the ultraviolet light emitted from the ultraviolet LED element 80 is condensed into a linear light beam by the condensing lens 82. Then, the ultraviolet light reaches the opening 74*a*, and is irradiated from the irradiation port 76*a* through the fiber-optic cable 76.

On the other hand, when the mirror member 84 is situated in the non-irradiation position, the ultraviolet light emitted from the ultraviolet LED element 80 is reflected by the mirror member 84, and therefore it does not reach the opening 74*a* and no ultraviolet light is irradiated from the irradiation port 76*a*. In this case, the ultraviolet light reflected by the mirror member 84 is absorbed by the ultraviolet light absorbing member 86.

Figure 8:
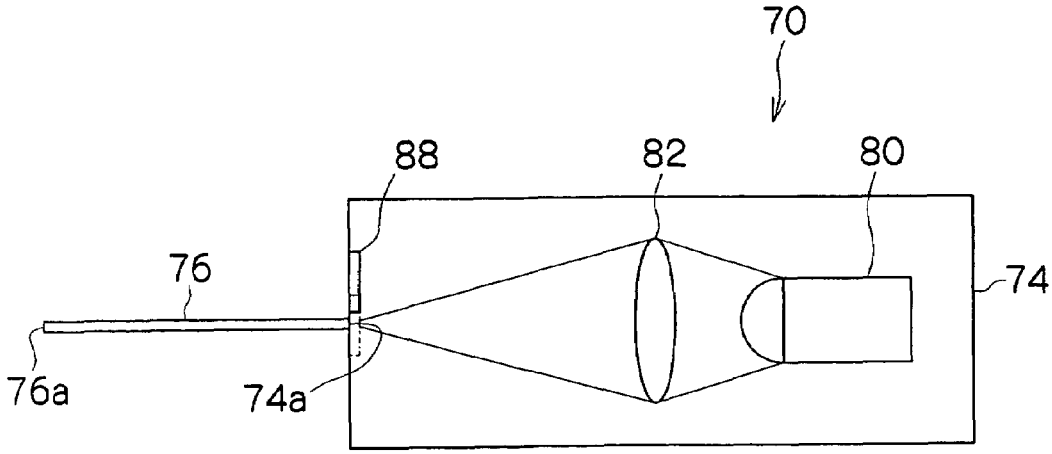
FIG. 8 is a cross-sectional view showing another example of the internal composition of the irradiation unit of the preliminary curing light source.

FIG. 8 is a cross-sectional view (a cross-section in the direction of the arrow 7A in FIG. 6) showing another example of the composition of the irradiation unit 70 of a preliminary curing light source 16. In FIG. 8, identical reference numerals denote parts that are common to FIG. 7, and description thereof is omitted here. In this example, at the respective opening 74*a* connected to one end of the fiber-optic cable 76, an opening and closing member 88 is provided on the inner wall of the shield surround 74, which is movable in the upward and downward direction in FIG. 8.

Each of the opening and closing members 88 is formed by an ultraviolet light absorbing member. When the opening and closing members 88 are situated in the irradiation positions indicated by the solid line in FIG. 8, the openings 74*a* are not closed off, and hence the ultraviolet lights condensed by the condensing lenses 82 reach to the openings 74*a*. On the other hand, when the opening and closing members 88 are situated in the non-irradiation positions indicated by the broken line in FIG. 8, the openings 74*a* are closed off, and hence the ultraviolet lights condensed by the condensing lenses 82 are absorbed by the opening and closing members 88 and the ultraviolet lights do not reach to the openings 74*a*.

By this composition, similarly to the compositional example of the irradiation unit 70 shown in FIG. 7, it is possible to select whether or not to irradiate the ultraviolet light from the irradiation ports 76*a* of the respective fiber-optic cables 76, onto the respective ink droplets landed on the recording paper 20, in accordance with the position of each of the opening and closing members 88.

Next, the relationship between the irradiation of ultraviolet light by the preliminary curing light source 16 and the ink ejection from the nozzles 51 will be described.

Figure 9:
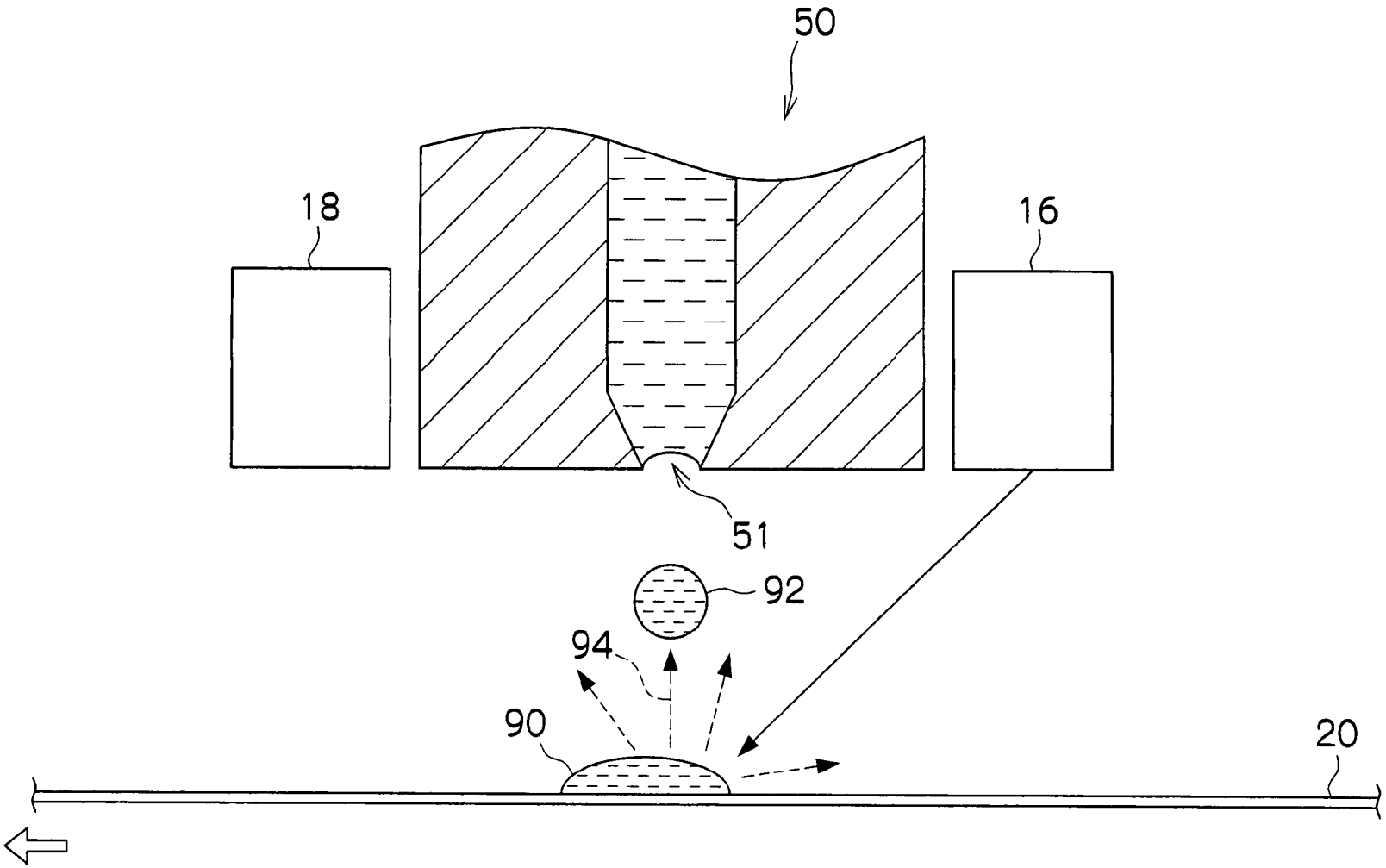
FIG. 9 is a diagram showing a method of irradiating an ultraviolet light in a case in which an ink is ejected from a nozzle in consecutive ejection cycles, showing a state in which a previously ejected first ink droplet has landed on the recording paper and a subsequently ejected second ink droplet is in flight.
Figure 10:
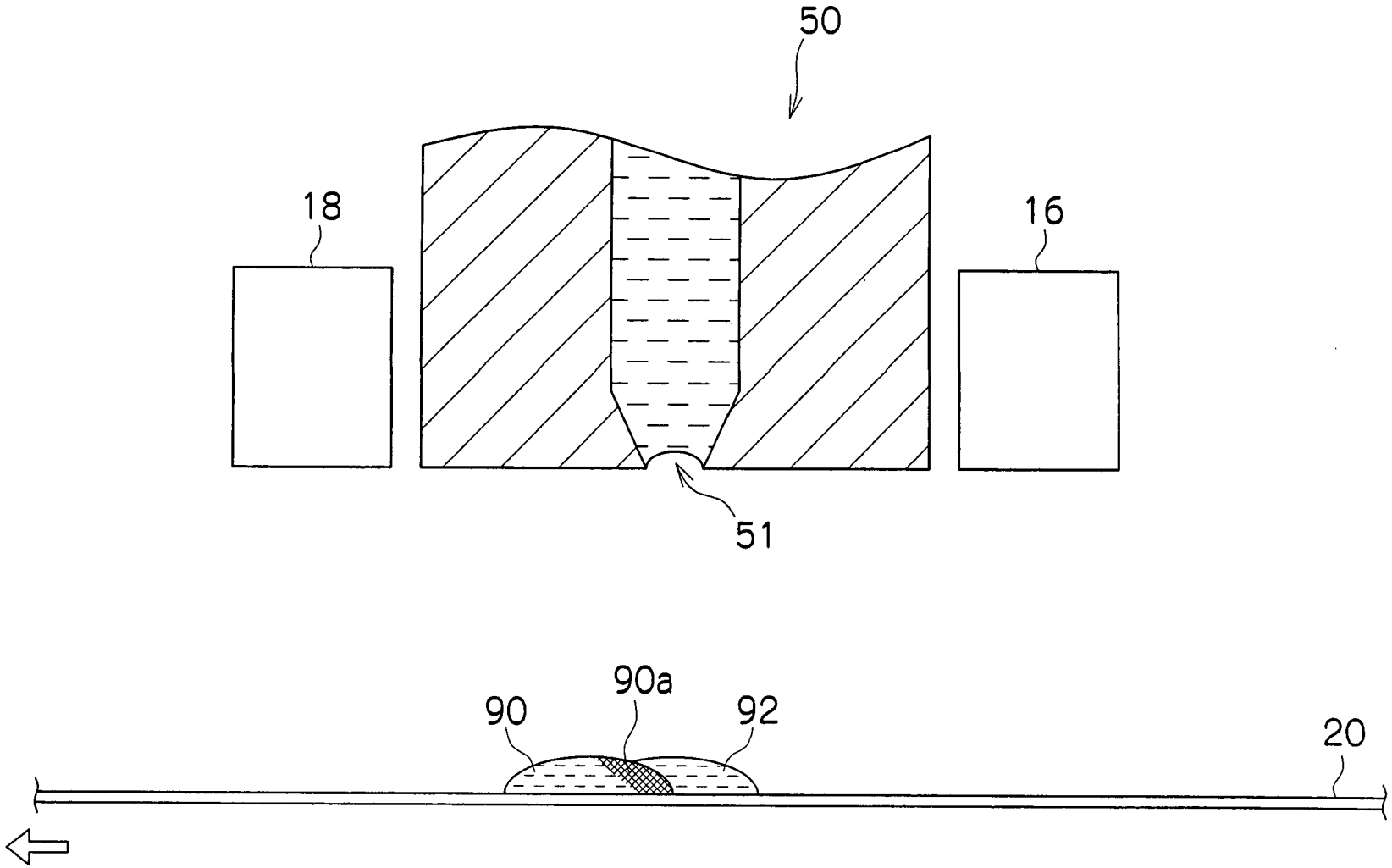
FIG. 10 is a diagram showing a method of irradiating the ultraviolet light in a case in which an ink is ejected from a nozzle in consecutive ejection cycles, showing a state in which the subsequently ejected second ink droplet has landed on the recording paper.
Figure 11:
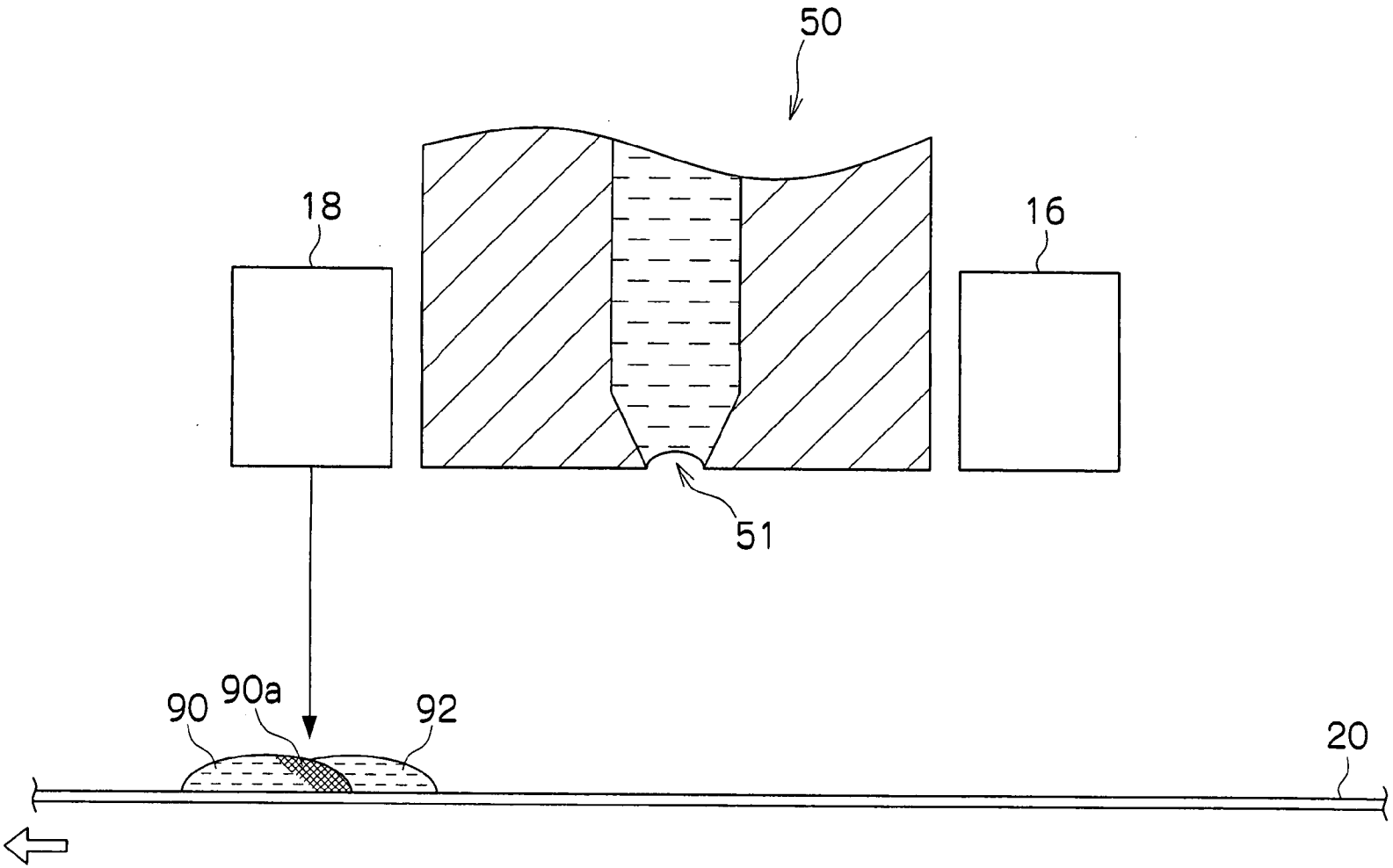
FIG. 11 is a diagram showing a method of irradiating the ultraviolet light in a case in which an ink is ejected from a nozzle in consecutive ejection cycles, showing a state in which the first and the second ink droplets on the recording paper have been conveyed to a position directly below a main curing light source.

FIGS. 9, 10, and 11 are diagrams showing an ultraviolet light irradiation method in a case in which the ink is ejected from the nozzle 51 in consecutive ejection cycles. FIG. 9 shows a state in which a first ink droplet 90 ejected previously from the nozzle 51 has landed on the recording paper 20, and a subsequently ejected second ink droplet 92 is in flight. FIG. 10 shows a state in which the recording paper 20 has been conveyed through a small distance in the paper conveyance direction indicated by the arrow in FIG. 10, whereupon the second ink droplet 92 has landed on the recording paper 20. FIG. 11 shows a state in which the recording paper 20 has been conveyed further, and the first and second ink droplets 90 and 92 on the recording paper 20 have been conveyed to a position directly below the main curing light source 18.

The preliminary curing light source 16 is disposed on the upstream side of the print head 50 including the nozzle 51 according to the paper conveyance direction, and the main curing light source 18 is disposed on the downstream side thereof.

If the first ink droplet 90 and the second ink droplet 92 are ejected from the nozzle 51 in consecutive ejection cycles, the first ink droplet 90 ejected previously firstly lands on the recording paper 20 as shown in FIG. 9. Next, as shown in FIG. 10, the first ink droplet 90 which has landed on the recording paper 20 is conveyed toward the downstream side in the paper conveyance direction indicated by the arrow in FIG. 10, and then the subsequently ejected second ink droplet 92 lands on the recording paper 20 so as to overlap partially with the first ink droplet 90 on the upstream side in the paper conveyance direction.

In addition, the preliminary curing light source 16 situated on the upstream side of the print head 50 in terms of the paper conveyance direction irradiates ultraviolet light onto the upstream side (in terms of the paper conveyance direction) of the first ink droplet 90 on the recording paper 20, as shown in FIG. 9. This irradiation position is formed so as to coincide with the overlapping region 90*a* (see FIG. 10) formed when the first and second ink droplets 90 and 92 have landed on the recording paper 20.

Furthermore, the preliminary curing light source 16 is controlled by a light source control unit (not shown in FIG. 9, but shown as reference numeral 128 in FIG. 14), so as to irradiate the ultraviolet light while the second ink droplet 92 is in flight. In other words, the preliminary curing light source 16 irradiates the ultraviolet light in synchronization with ejecting the ink from the nozzle 51.

By this composition, when the first and the second ink droplets 90 and 92 are ejected in consecutive ejection cycles from the nozzle 51, the ultraviolet light is irradiated onto the upstream side (in terms of the paper conveyance direction) of the first ink droplet 90 on the recording paper 20, while the second ink droplet 92 is in flight.

At this time, a large proportion of the ultraviolet light irradiated onto the first ink droplet 90 is absorbed by the first ink droplet 90, or is reflected perpendicularly. However, a portion of the ultraviolet light is reflected in random directions as indicated by the broken arrows in FIG. 9. The ultraviolet reflected in random directions includes the reflected light (ultraviolet light) 94 directed toward the nozzle 51 indicated by dashed arrows in FIG. 9.

The second ink droplet 92 which is in flight is exposed to the reflected light 94, and the reflected light 94 is absorbed, or is reflected perpendicularly, or is refracted by the second ink droplet 92. Therefore, hardly any of the reflected light 94 reaches the nozzle 51, and hence there is no hardening of the ink in the vicinity of the nozzle.

The portion of the first ink droplet 90 on the upstream side of the paper conveyance direction is irradiated with ultraviolet light by the preliminary curing light source 16, which is hardened. As described previously, this hardened portion (portion irradiated with the ultraviolet light) coincides with the overlapping region 90*a* between the first and the second ink droplets 90 and 92. Therefore, as shown in FIG. 10, landing interference does not occur when the second ink droplet 92 is deposited onto the recording paper 20 so as to overlap with the first ink droplet 90.

As shown in FIG. 11, the first and the second ink droplets 90 and 92 on the recording paper 20 are conveyed toward the downstream side of the paper conveyance direction, and the ultraviolet light is irradiated onto same at a position directly below the main curing light source 18, thereby completely fixing the first and the second ink droplets 90 and 92.

In this way, when ink is ejected from a nozzle 51 in consecutive ejection cycles, since the preliminary curing light source 16 irradiates ultraviolet light onto the first ink droplet 90 on the recording paper 20, while the subsequently ejected second ink droplet 92 is in flight. Therefore, it is possible to prevent hardening of the ink in the vicinity of the nozzle while also preventing landing interference between the first and the second ink droplets 90 and 92 which are ejected in consecutive ejection cycles from the same nozzle.

In implementing the present invention, the irradiation of the ultraviolet light by the preliminary curing light source 16 is not limited to the case in which ink is ejected from the nozzle 51 in consecutive ejection cycles, and it may also be performed in other cases in which the first and the second ink droplets 90 and 92 ejected by the nozzle 51 are to overlap or make contact with each other on the recording paper 20. For example, in a case in which a first ink droplet 90 is ejected in a first ejection cycle, no ink is ejected in the subsequent ejection cycle, and a second ink droplet 92 is then ejected in the second ejection cycle, landing interference may occur, depending on the size of the first and the second ink droplets 90 and 92 which have landed on the recording paper 20. Therefore, since the ultraviolet light is also irradiated onto the first ink droplet 90 while the second ink droplet 92 is in flight, it is also possible to prevent landing interference and hardening of the ink in the vicinity of the nozzle.

Figure 12:
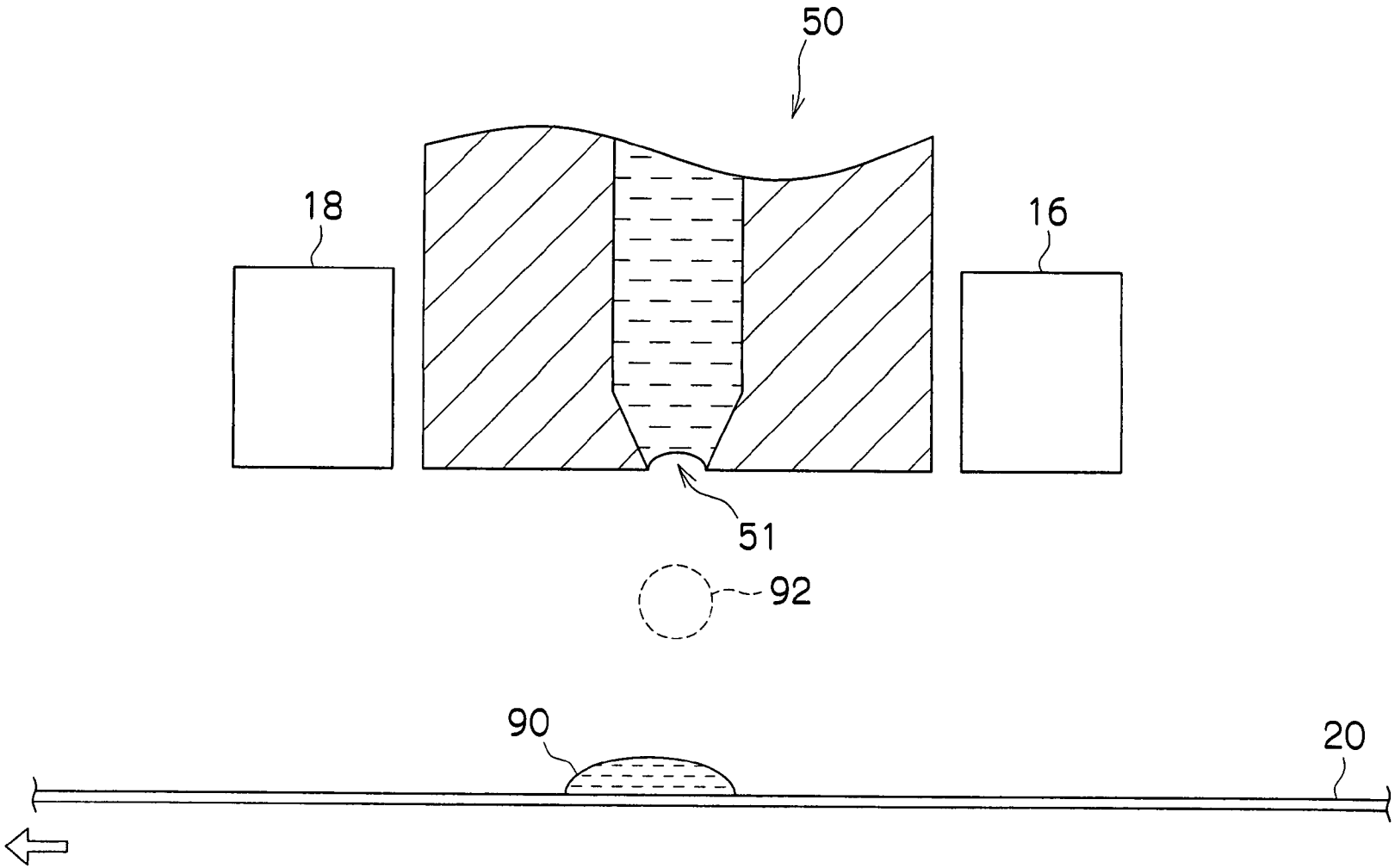
FIG. 12 is a diagram showing a method of irradiating the ultraviolet light in a case in which an ink is not ejected from a nozzle in consecutive ejection cycles, showing a state in which the first ink droplet has landed on the recording paper.
Figure 13:
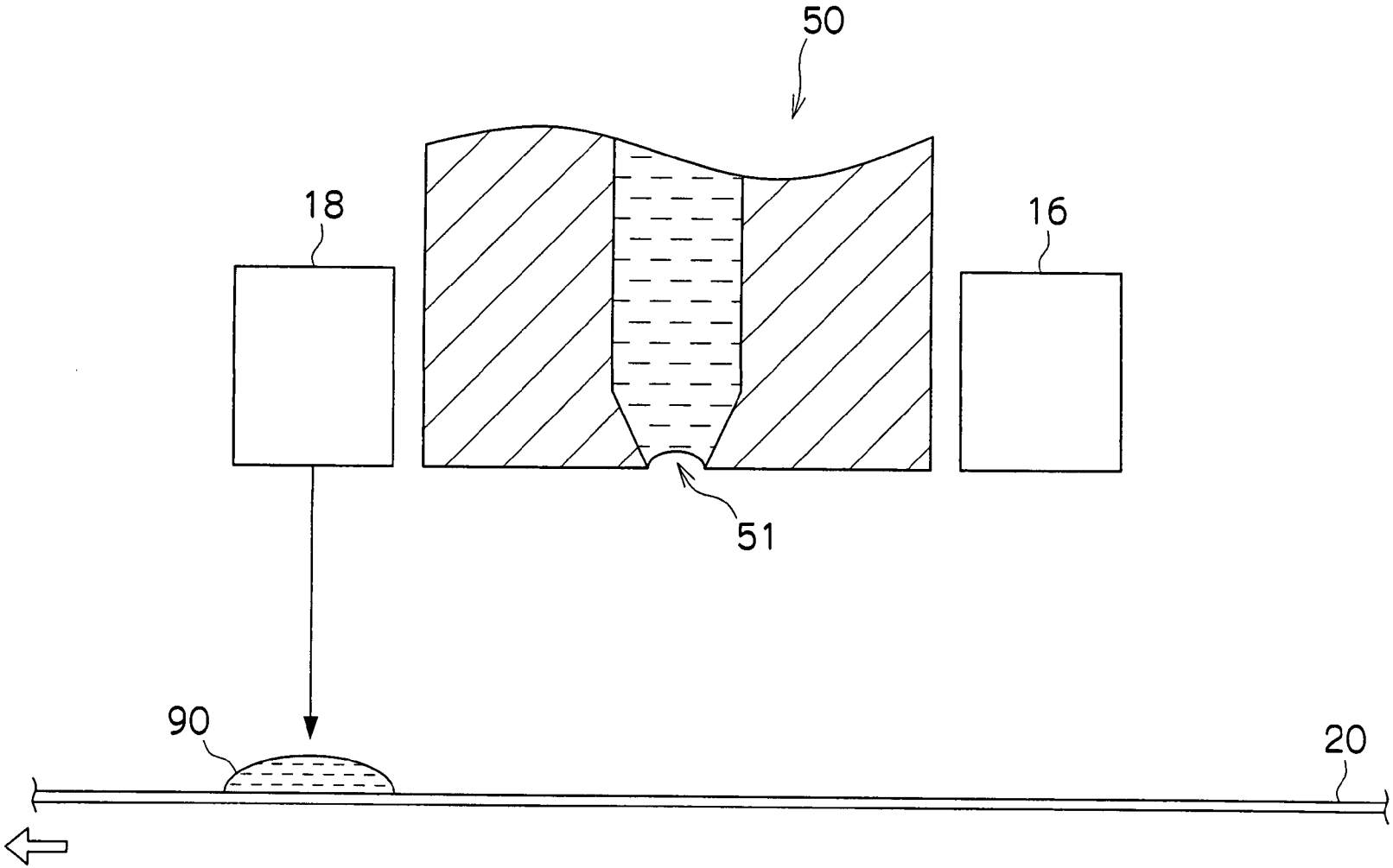
FIG. 13 is a diagram showing a method of irradiating the ultraviolet light in a case in which an ink is ejected from a nozzle in consecutive ejection cycles, showing a state that the first ink droplet on the recording paper have been conveyed to the position directly below the main curing light source.

FIGS. 12 and 13 are diagrams showing an ultraviolet light irradiation method in a case in which the ink is not ejected from the nozzle 51 in consecutive ejection cycles. FIG. 12 shows a state in which a first ink droplet 90 ejected from a nozzle 51 has landed on the recording paper 20. FIG. 13 shows a state in which the first ink droplet 90 on the recording paper 20 has been conveyed to a position directly below the main curing light source 18. In FIGS. 12 and 13, identical reference numerals denote parts that are common to FIGS. 9 to 11, and description thereof is omitted here.

As shown in FIG. 12, when a second ink droplet 92 is not ejected from the nozzle 51 subsequently to the first ink droplet 90, the preliminary curing light source 16 does not irradiate ultraviolet light onto the first ink droplet 90. Therefore, the ink in the vicinity of the nozzle is not hardened by the reflected light.

In addition, since no ultraviolet light is irradiated onto same by the preliminary curing light source 16, the first ink droplet 90 is not hardened. However, since a second ink droplet 92 is not ejected from the nozzle 51 in a consecutive ejection cycle, landing interference does not occur.

As shown in FIG. 13, the first ink droplet 90 on the recording paper 20 is conveyed toward the downstream side of the paper conveyance direction, and then is irradiated with the ultraviolet light at a position directly below the main curing light source 18, thereby completely fixing the ink droplet.

Description of Control System

Next, the control system of the inkjet recording apparatus 10 will be described.

Figure 14:
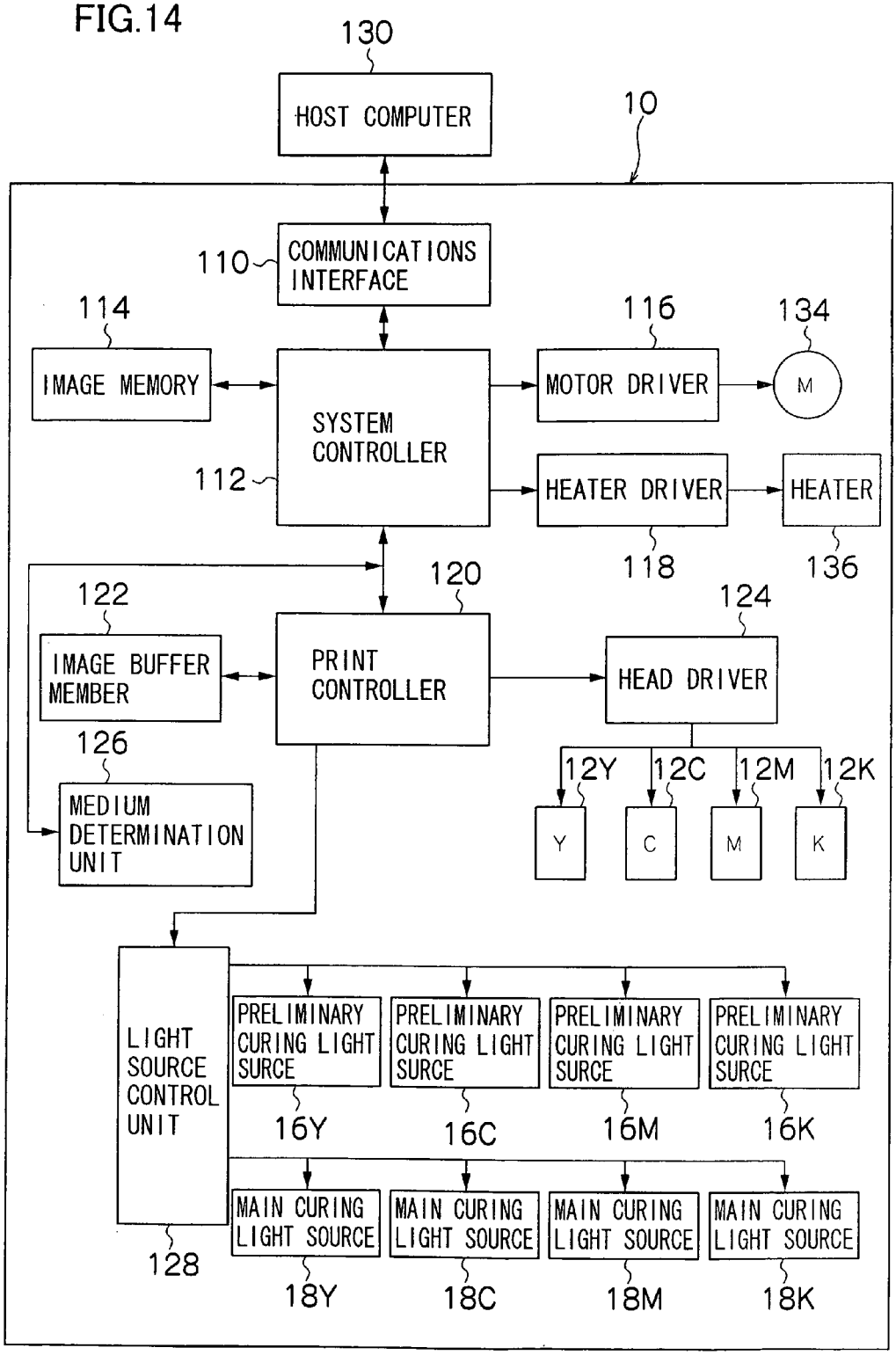
FIG. 14 is a principal block diagram of the system composition of the inkjet recording apparatus illustrated in FIG. 1.

FIG. 14 is a principal block diagram showing the system configuration of the inkjet recording apparatus 10. The inkjet recording apparatus 10 comprises a communication interface 110, a system controller 112, an image memory 114, a motor driver 116, a heater driver 118, a print controller 120, an image buffer memory 122, a head driver 124, a medium determination unit 126, a light source control unit 128, and other components.

The communication interface 110 is an interface unit for receiving image data sent from a host computer 130. A serial interface such as USB, IEEE1394, Ethernet, wireless network, or a parallel interface such as a Centronics interface may be used as the communication interface 110. A buffer memory (not shown) may be mounted in this portion in order to increase the communication speed. The image data sent from the host computer 130 is received by the inkjet recording apparatus 10 through the communication interface 110, and is temporarily stored in the image memory 114. The image memory 114 is a storage device for temporarily storing images inputted through the communication interface 110, and data is written and read to and from the image memory 114 through the system controller 112. The image memory 114 is not limited to a memory composed of semiconductor elements, and a hard disk drive or another magnetic medium may be used.

The system controller 112 is a control unit for controlling the various sections, such as the communications interface 110, the image memory 114, the motor driver 116, the heater driver 118, and the like. The system controller 112 is constituted by a central processing unit (CPU) and peripheral circuits thereof, and the like, and in addition to controlling communications with the host computer 130 and controlling reading and writing from and to the image memory 114, or the like, it also generates a control signal for controlling the motor 134 of the conveyance system and the heater 136.

The motor driver 116 is a driver (drive circuit) which drives the motor 134 in accordance with instructions from the system controller 112. The heater driver 118 is a driver for driving the heater 136 of the heating drum 34, and other sections, in accordance with instructions from the system controller 112.

The print controller 120 has a signal processing function for performing various tasks, compensations, and other types of processing for generating print control signals from the image data stored in the image memory 114 in accordance with commands from the system controller 112 so as to supply the generated print control signal (dot data) to the head driver 124. Prescribed signal processing is carried out in the print controller 120, and the ejection amount and the ejection timing of the ink droplets from the respective print heads 12K, 12M, 12C, and 12Y with respect to the ink colors are controlled via the head driver 124, according to the print data. By this means, prescribed dot size and dot positions can be achieved.

The print controller 120 is provided with the image buffer memory 122; and image data, parameters, and other data are temporarily stored in the image buffer memory 122 when image data is processed in the print controller 120. The aspect shown in FIG. 14 is one in which the image buffer memory 122 accompanies the print controller 120; however, the image memory 114 may also serve as the image buffer memory 122. Also possible is an aspect in which the print controller 120 and the system controller 112 are integrated to form a single processor.

The head driver 124 drives the actuators 58 which drive ejection in the respective heads 12K, 12M, 12C and 12Y, according to the dot data supplied from the print controller 120. A feedback control system for maintaining constant drive conditions for the print heads may be included in the head driver 124.

The image data to be printed is externally inputted through the communications interface 110, and is stored in the image memory 114. At this stage, RGB image data is stored in the image memory 114, for example. The image data stored in the image memory 114 is sent to the print controller 120 through the system controller 112, and is converted to the dot data for each ink color by a known dithering algorithm, random dithering algorithm or another technique in the print controller 120.

The print heads 12K, 12M, 12C, and 12Y are driven according to the dot data thus generated by the print controller 120, so that ink is ejected from the heads. By controlling ink ejection from the print heads 12K, 12M, 12C, and 12Y in synchronization with the conveyance speed of the recording paper 20, an image is formed on the recording paper 20.

The medium determination unit 126 is a device for determining the type and size of the recording paper 20. This section uses, for example, a device for reading in information such as bar codes attached to the magazine 32 in the paper supply unit 22, or sensors disposed at a suitable position in the paper conveyance path (a paper width determination sensor, a sensor for determining the thickness of the paper, a sensor for determining the reflectivity of the paper, and so on). A suitable combination of those elements may also be used. Furthermore, it is also possible to adopt a composition in which information relating to the paper type, size, or the like, is specified by means of an input via a prescribed user interface, instead of or in conjunction with such automatic determining devices.

Information obtained by the medium determination unit 126 is reported to the system controller 112 and/or the print controller 120, and is used to control the ink ejection and to control the preliminary curing light sources 16K, 16M, 16C and 16Y.

The light source control unit 128 is constituted by a preliminary curing light source control circuit for controlling the on/off switching, the lighting up positions, the light emission intensities, and the like, to the preliminary curing light sources 16K, 16M, 16C and 16Y; and a main curing light source control circuit for controlling the on/off switching, the light emission intensity, and the like, to the main curing light sources 18K, 18M, 18C and 18Y. The light source control unit 128 controls the emission of light by the respective light source (16K, 16M, 16C, 16Y, 18K, 18M, 18C and 18Y), in accordance with commands from the print controller 120.

In particular, in the present embodiment, the preliminary curing light source control circuit controls the irradiation/non-irradiation position relating to the mirror members 84 (see FIG. 7) or the opening and closing members 88 (see FIG. 9) in the irradiation units 70 of the preliminary curing light sources 16K, 16M, 16C and 16Y, according to commands from the print controller 120. Thereby, the irradiation/non-irradiation of ultraviolet light from the preliminary curing light sources 16K, 16M, 16C and 16Y is performed in synchronization with the ink ejection operation from the nozzles 51.

In implementing the present invention, the method of controlling the ultraviolet light from the preliminary curing light sources 16K, 16M, 16C and 16Y is not limited to that of the present embodiment, particularly.

Another Embodiment

Next, another embodiment of the present invention will be described.

Figure 15:
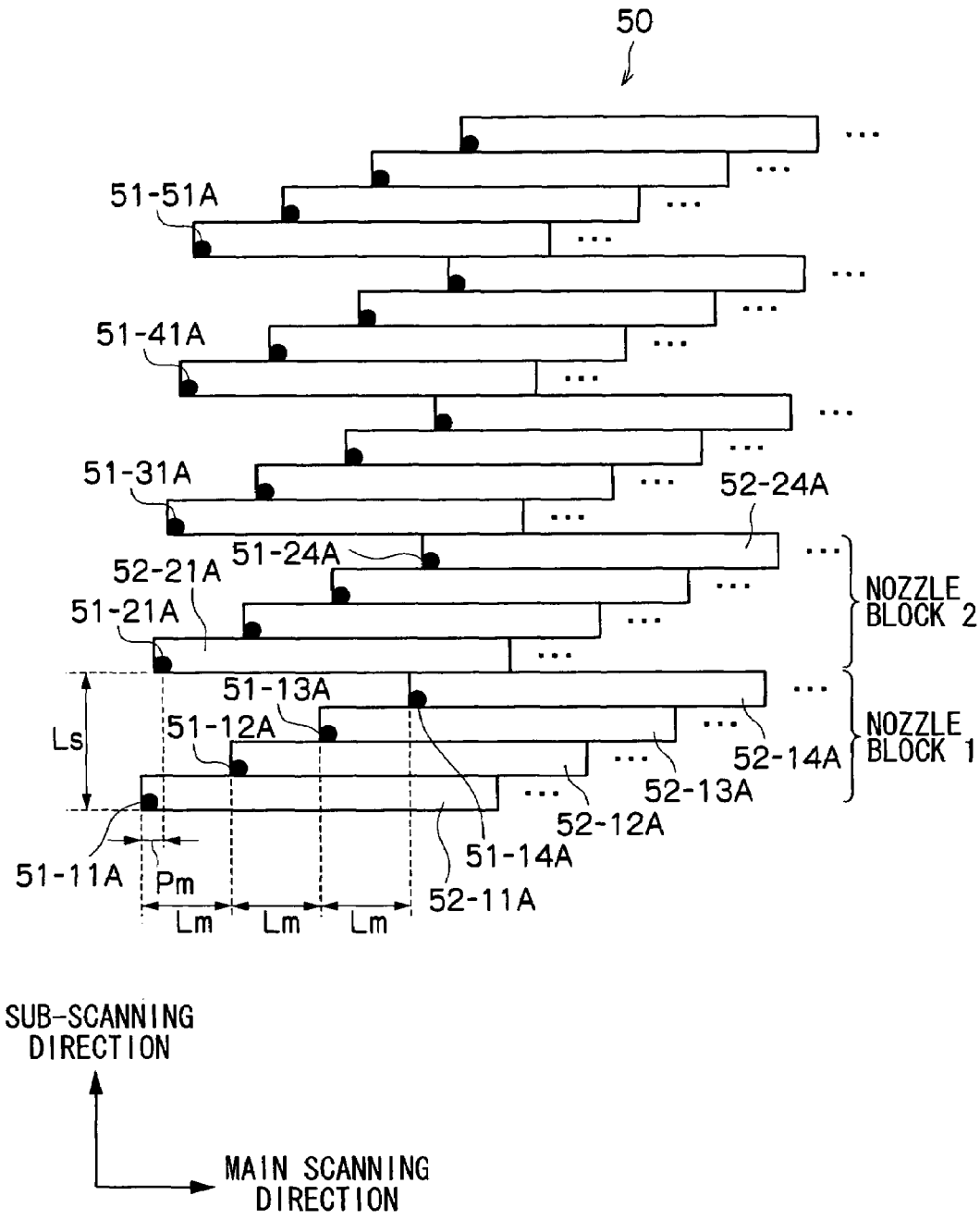
FIG. 15 is an enlarged plan view of a portion of a nozzle arrangement of a print head according to another embodiment.
Figure 16:
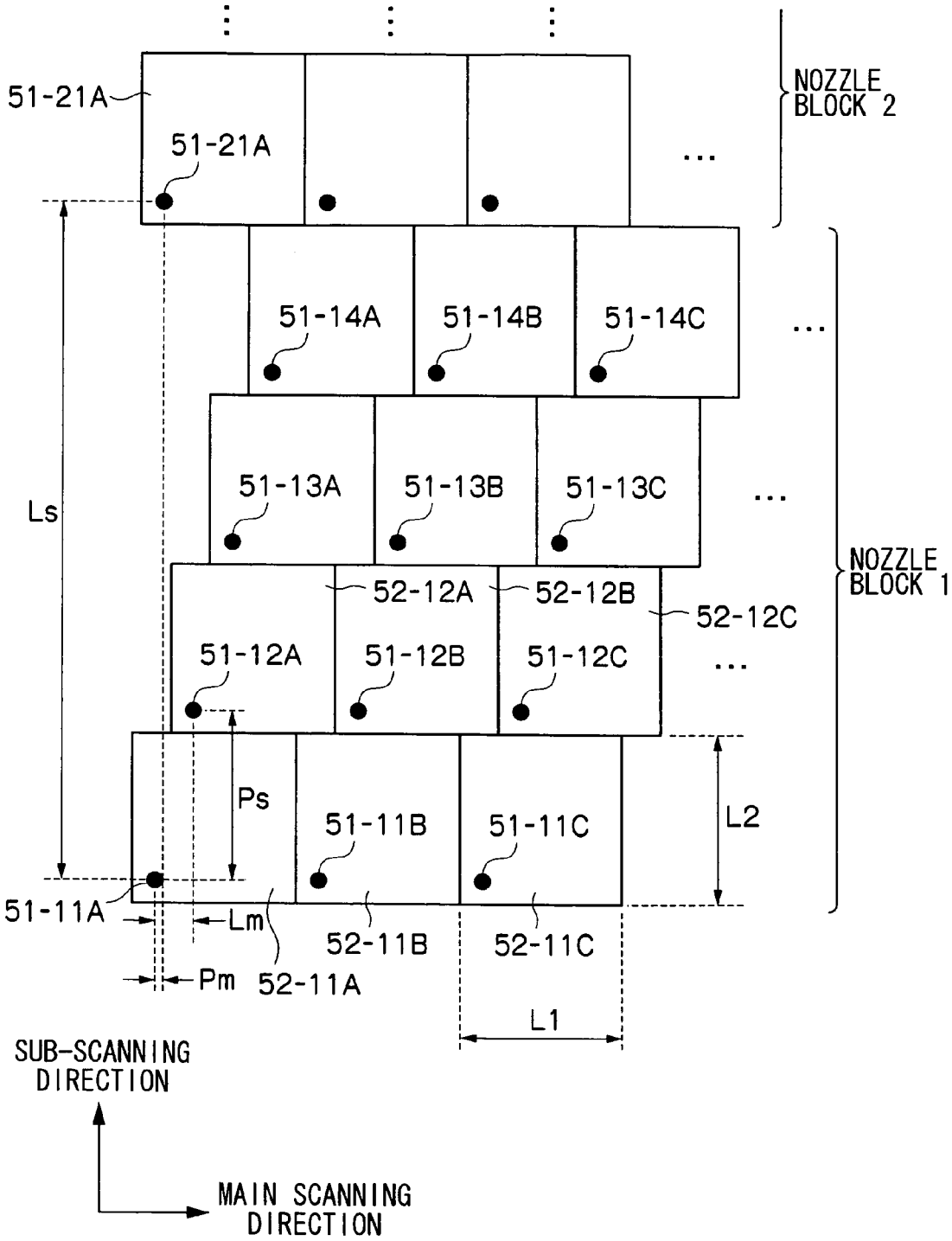
FIG. 16 is a partial enlarged view of the lower left-hand portion of FIG. 15.

FIG. 15 is an enlarged plan view showing a portion of a nozzle arrangement of a print head 50 according to the present embodiment. Though the pressure chambers 52 shown in FIG. 4 are approximately square in shape, the dimension of each pressure chamber 52 in the sub-scanning direction is depicted in FIG. 15 at a reduced scale of 1/20 with respect to the main scanning direction. FIG. 16 is a partial enlarged view of the lower left-hand portion of FIG. 15, showing both the vertical and horizontal dimensions of the pressure chambers 52 according to a standard scale. In FIGS. 15 and 16, identical reference numerals denote parts that are common to FIG. 4, and description thereof is omitted here.

FIG. 15 shows only a pressure chamber 52 on the further left-hand side in the main scanning direction. In the example shown in FIG. 15, the print head 50 has twenty pressure chambers 52 (52-11A, 52-12A, . . . 52-21A, . . . , and so on) arranged in the sub-scanning direction, and each of the pressure chambers 52 has a nozzle 51(51-11A, 51-12A, . . . , and so on) disposed respectively at a standard position in the lower left corner.

Therefore, the print head 50 has twenty nozzles 51 (51-11A, 51-12A, . . . , 51-12A, . . . , and so on) arranged in the sub-scanning direction. In addition, as shown in FIG. 16, the plurality of pressure chambers 52 and nozzles 51 are also arranged in the main scanning direction. For example, in FIG. 16, while the pressure chambers 52 are arranged in the lowest row in the main scanning direction from the left-hand side as pressure chambers 52-11A, 52-11B, 52-11C, . . . , the pressure chambers 52 are arranged in the row above this in the main scanning direction, in order of the pressure chambers 52-12A, 52-12B, 52-12C, . . . .

Furthermore, similarly to those, while the nozzles 51 are arranged in the lowest row in the main scanning direction from the left-hand side as the nozzles 51-11A, 51-11B, 51-11C, . . . , the nozzles 51 are arranged in the row above this in the main scanning direction as the nozzles 51-12A, 51-12B, 51-12C, . . . .

In the present embodiment, a row of nozzles 51 in which a plurality of nozzles 51 are arranged in one row in the main scanning direction in this way, for example, the row of nozzles, 51-1A, 51-11B, 51-11C, . . . , and so on, is referred to as a "nozzle row".

In the example shown in FIG. 15, twenty nozzle rows in which a plurality of nozzles 51 are aligned in the main scanning direction are arranged in the sub-scanning direction, and the twenty nozzle rows arranged in the sub-scanning direction are divided into sets of four nozzle rows which are arranged adjacently in the sub-scanning direction. Those four nozzle rows arranged adjacently in the sub-scanning direction (for example, the four nozzle rows in which the nozzles 51 at the furthest left-hand ends of nozzle rows respectively correspond to the nozzles 51-11A, 51-12A, 51-13A and 51-14A) are referred to as a "nozzle block". Therefore, in the example shown in FIG. 15, all of the nozzles depicted in FIG. 15 can be divided into five nozzle blocks.

In FIG. 16, the nozzle block in which four nozzle rows are arranged consecutively and adjacently in the sub-scanning direction, in an oblique upward direction from the lowermost row, namely, the nozzle rows (51-11A, 51-11B, 51-11C, . . . ), (51-12A, 51-12B, 51-12C, . . . ), (51-13A, 51-13B, 51-13C, . . . ), and (51-14A, 51-14B, 51-14C, . . . ), is referred to as a nozzle block 1. The nozzle block in which the four nozzle rows are arranged adjacently in the sub-scanning direction, obliquely above nozzle block 1, is referred to as a nozzle block 2. Hereafter, the print head 50 is similarly constituted by five nozzle blocks each having four nozzle rows.

As shown in FIG. 15, the respective nozzle rows in the nozzle block 1 are arranged obliquely and adjacently in the sub-scanning direction, being arranged respectively in a distance Lm of the main scanning direction, as indicated by the nozzles 51-11A, 51-12A, 51-13A and 51-14A at the left-hand ends of the nozzle rows, which represent all of the nozzle rows. The nozzle block 2 and other nozzle blocks are similar to the nozzle block 1. Furthermore, the nozzle block 1 and the nozzle block 2 are disposed so as to be arranged in a distance Pm of the main scanning direction and a distance Ls of the sub-scanning direction, as indicated by the corresponding nozzles 51-11A and 51-21A.

The distance Pm in the main scanning direction is a minimum distance between nozzles in the main scanning direction of the nozzle arrangement in the print head 50 according to the present embodiment. In the present embodiment, dots which are mutually adjacent in the main scanning direction on the recording paper 20 are ejected by the nozzles 51 (for example, nozzles 51-11A and 51-21A) positioned adjacently in the main scanning direction. The minimum distance Pm between the nozzles 51 in the main scanning direction is same as the minimum distance Pd between the dots on the recording paper 20.

In each the nozzle block, the distance between nozzles that are adjacent in the sub-scanning direction, for example, the distance Ps in the sub-scanning direction between the nozzle 51-11A and the nozzle 51-12A of the nozzle block 1 in FIG. 16 is a minimum distance between the nozzles 51 in the sub-scanning direction (namely, the nozzle pitch in the sub-scanning direction). At this time, the thickness of the partitions between the pressure chambers 52, and other factors, should be taken into consideration, but herein, it is assumed that this distance is equal to a length L2 of the pressure chamber 52-11A in the sub-scanning direction.

Furthermore, when a length of the pressure chamber 52-11A in the main scanning direction is L1, a minimum distance in the main scanning direction between the nozzles 51 in the same nozzle row (for example, a distance between nozzle 51-11A and nozzle 51-11B) is approximately L1. As described above, the pressure chamber 52 is approximately square in shape, and hence it is possible to assume that L1=L2.

The distance Ls in the sub-scanning direction between the nozzle block 1 and the nozzle block 2 is obtained by multiplying the minimum distance Ps between the nozzles 51 in the sub-scanning direction in the nozzle arrangement according to the present embodiment by the number M (where M is a positive integer) of nozzle rows constituting each nozzle block. In other words, Ls=M×Ps. As shown in FIG. 16, in this example, each of the nozzle blocks include four nozzle rows in the sub-scanning direction (for example, the nozzle block 1 includes four nozzle rows of which the left-hand end nozzles 51 are the nozzles 51-11A, 51-12A, 51-13A and 51-14A, respectively.) Therefore, M=4 and Ls=4×Ps.

The distance in the main scanning direction between the nozzle 51-11A in nozzle block 1 and the nozzle 51-21A in nozzle block 2 is the minimum distance Pm between the nozzles 51 for the nozzle arrangement according to the present example, and a dot ejected on the recording paper 20 by the nozzle 51-11A overlaps with a dot ejected by nozzle 51-21A after conveying the recording paper 20 through the distance Ls which is the distance between nozzle blocks in the sub-scanning direction. Therefore, the distance between the nozzle 51-11A and the nozzle 51-21A which eject the ink droplets to form the dots that are mutually adjacent and overlapping in the main scanning direction on the recording paper 20, is four times in contradistinction to a distance in the conventional nozzle arrangement shown in FIG. 4. Therefore, if the conveyance speed of the recording paper 20 is in constant, then the time interval between the depositing times of ink droplets which are adjacent in the main scanning direction on the recording paper 20 is four times in contradistinction to the time interval in a case in which the nozzles 51 are simply arranged in an oblique fashion as shown in FIG. 4. Therefore, even if the ink droplets are ejected so as to overlap with each other, landing interference does not occur between the ink droplets. In other words, it is possible to prevent landing interference in the main scanning direction.

In this way, in the present embodiment, by adapting the print head 50 having the nozzle arrangement shown in FIG. 14 and FIG. 15 in the composition shown in FIG. 6, it is possible to prevent landing interference between ink droplets which land on the recording paper 20 in mutually adjacent positions in the main scanning direction, while preventing landing interference in the sub-scanning direction (paper conveyance direction) due to irradiation of ultraviolet light by the preliminary curing light sources 16.

In the foregoing description, an ink is described as an ultraviolet-curable ink, but the ink is not limited to the ultraviolet-curable ink in implementing the present invention, and other radiation-curable inks which are hardened by electron beams, X-rays, or the like, may also be used. In this case, a light source using a radiation source suitable for activating the hardening agent (namely, activating polymerization) is provided, according to the type of ink used.

The image forming apparatus according to the present invention has been described in detail above, but it should be understood, however, that there is no intention to limit the invention to the specific forms disclosed, but on the contrary, the invention is to cover all modifications, alternate constructions and equivalents falling within the spirit and scope of the invention as expressed in the appended claims.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An image forming apparatus, comprising:

a print head including a plurality of nozzles which eject droplets of a radiation-curable ink onto a recording medium;

a conveyance device which causes the print head and the recording medium to relatively move to each other in a relative conveyance direction of the recording medium by conveying at least one of the print head and the recording medium in a direction substantially perpendicular to a width direction of the recording medium;

an irradiation device which irradiates a radiation to the droplets of the ink, the droplets having landed on the recording medium; and a control device which controls the irradiation device so that the radiation is irradiated to a first ink droplet while a second ink droplet is in flight, the first ink droplet having been previously ejected from one of the nozzles in the print head and having landed on the recording medium, the second ink droplet being ejected from the same one of the nozzles so as to overlap with or make contact with the first ink droplet on the recording medium, wherein the second ink droplet absorbs some of the radiation reflected off of the first ink droplet when the radiation is irradiated to the first ink droplet while the second ink droplet is in flight, thereby reducing the amount of radiation reaching the nozzle from which both first and second droplets were ejected.

2. The image forming apparatus as defined in claim 1, wherein the first ink droplet and the second ink droplet are ejected from the same one of the nozzles in consecutive ejection cycles.

3. The image forming apparatus as defined in claim 1, wherein the first ink droplet and the second ink droplet are aligned in the relative conveyance direction when landing on the recording medium.

4. The image forming apparatus as defined in claim 3, wherein the irradiation device irradiates the radiation to at least a region of the first ink droplet on the recording medium, the region of the first ink droplet overlapping with the second ink droplet.

5. The image forming apparatus as defined in claim 4, wherein the irradiation device is disposed on an upstream side with respect to the print head in the relative conveyance direction.

6. The image forming apparatus as defined in claim 1, wherein the control device controls the irradiation device so that the radiation is not irradiated to the first ink droplet on the recording medium when the second ink droplet is ejected so as not to overlap with or make contact with the first ink droplet on the recording medium.

7. The image forming apparatus as defined in claim 6, wherein the control device controls the irradiation device so that the radiation is not irradiated to the first ink droplet on the recording medium when the first ink droplet and the second ink droplet are not ejected in consecutive ejection cycles from same one of the nozzles.

8. The image forming apparatus as defined in claim 1, further comprising:

a main curing device which irradiates the radiation for full-hardening the droplets of the ink, the main curing device being disposed on a downstream side of the print head in the relative conveyance direction, wherein the irradiation device irradiates the radiation at a level for semi-hardening an ink droplet which lands on the recording medium so that the ink droplet does not combine with the other droplets of the ink on the recording medium.

9. The image forming apparatus as defined in claim 8, wherein:

an ultraviolet-curable ink is used as the radiation-curable ink; and the radiation irradiated by the main curing device is an ultraviolet light.

10. The image forming apparatus as defined in claim 1, wherein:

an ultraviolet-curable ink is used as the radiation-curable ink; and the radiation irradiated by the irradiation device is an ultraviolet light.

11. The image forming apparatus as defined in claim 1, wherein:

the nozzles are arranged in the print head two-dimensionally in a main scanning direction and a sub-scanning direction so that at least a few of dots overlap with each other in the main scanning direction, the main scanning direction being substantially perpendicular to a relative conveyance direction of the recording medium, the sub-scanning direction coinciding with the relative conveyance direction of the recording medium, the dots being formed on the recording medium by the droplets ejected from the nozzles;

a distance in the sub-scanning direction between a first nozzle and a second nozzle is equal to an integral multiple of a distance in the sub-scanning direction between the first nozzle and a third nozzle, the first nozzle and the second nozzle ejecting the droplets to form mutually adjacent dots in the main scanning direction on the recording medium, the third nozzle being disposed adjacent to the first nozzle in the sub-scanning direction, the integral being at least two or more; and the first nozzle and the third nozzle are arranged in the main scanning direction so that a distance in the main scanning direction between the first nozzle and the third nozzle is no smaller than a maximum diameter of the dots formed on the recording medium by the droplets ejected from the first nozzle and the third nozzle.

12. An image forming method for an image forming apparatus comprising: a print head including a plurality of nozzles which eject an ultraviolet-curable ink onto a recording medium; and a conveyance device which causes the print head and the recording medium to relatively move to each other in a relative conveyance direction of the recording medium by conveying at least one of the print head and the recording medium in a direction substantially perpendicular to a width direction of the recording medium, the method comprising the steps of:

irradiating a radiation to droplets of the ink, the droplets having landed on the recording medium; and controlling an irradiation in the irradiating step so that the radiation is irradiated to a first ink droplet while a second ink droplet is in flight, the first ink droplet having been previously ejected from one of the nozzles in the print head and having landed on the recording medium, the second ink droplet being ejected from the same one of the nozzles so as to overlap with or make contact with the first ink droplet on the recording medium wherein the second ink droplet absorbs some of the radiation reflected off of the first ink droplet when the radiation is irradiated to the first ink droplet while the second ink droplet is in flight, thereby reducing the amount of radiation reaching the nozzle from which both first and second droplets were ejected.

* * * * *